US011181857B2

(12) United States Patent
Ikegami et al.

(10) Patent No.: US 11,181,857 B2
(45) Date of Patent: Nov. 23, 2021

(54) IMAGE FORMING APPARATUS MOVING DEVELOPING ROLLERS TOWARD AND AWAY FROM CORRESPONDING PHOTOSENSITIVE DRUMS BASED ON SHEET INTERVAL BETWEEN TWO SHEETS

(71) Applicant: BROTHER KOGYO KABUSHIKI KAISHA, Nagoya (JP)

(72) Inventors: Yusuke Ikegami, Nagoya (JP); Masahito Saeki, Nagoya (JP); Toshiyuki Sano, Iwakura (JP); Shintaro Sakaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/095,493

(22) Filed: Nov. 11, 2020

(65) Prior Publication Data

US 2021/0141327 A1 May 13, 2021

(30) Foreign Application Priority Data

Nov. 13, 2019 (JP) ..... JP2019-205425

(51) Int. Cl.
*G03G 15/01* (2006.01)
*G03G 15/00* (2006.01)

(52) U.S. Cl.
CPC ..... *G03G 15/50* (2013.01); *G03G 15/01* (2013.01); *G03G 2215/00025* (2013.01); *G03G 2215/01* (2013.01)

(58) Field of Classification Search
None
See application file for complete search history.

(56) References Cited

U.S. PATENT DOCUMENTS 7,430,382 B2 * 9/2008 Sugaya ..... G03G 15/0194 399/299
9,563,170 B2 * 2/2017 Kitamura ..... G03G 21/1825
(Continued)

FOREIGN PATENT DOCUMENTS

JP 2006-292868 A 10/2006
JP 2012-022142 A 2/2012
(Continued)

*Primary Examiner* — Clayton E. LaBalle
*Assistant Examiner* — Leon W Rhodes, Jr.
(74) *Attorney, Agent, or Firm* — Merchant & Gould P.C.

(57) ABSTRACT

An image forming apparatus includes: a first developing roller movable between a first contact position and a first separated position; a second developing roller movable between a second contact position and a second separated position; and a controller. When a sheet interval is shorter than a first interval and is longer than or equal to a second interval, the controller maintains the first developing roller at the first contact position even after the completion of its development for a preceding sheet, controls the first developing roller to start development for a subsequent sheet, moves the second developing roller to the second separated position after the completion of its development for the preceding sheet, moves the second developing roller again to the second contact position, and controls the second developing roller to start development for the subsequent sheet after the second developing roller is moved again to the second contact position.

8 Claims, 11 Drawing Sheets

(56) References Cited

U.S. PATENT DOCUMENTS

| | | | | |
|---|---|---|---|---|
| 9,791,803 | B2 * | 10/2017 | Sawashima ..... | G03G 15/0808 |
| 10,452,014 | B2 * | 10/2019 | Nemoto ..... | G03G 15/0136 |
| 2012/0014717 | A1 | 1/2012 | Sugiyama | |

FOREIGN PATENT DOCUMENTS

| | | | |
|---|---|---|---|
| JP | 2012-128017 | A | 7/2012 |
| JP | 2015-206942 | A | 11/2015 |

* cited by examiner

IMAGE FORMING APPARATUS MOVING DEVELOPING ROLLERS TOWARD AND AWAY FROM CORRESPONDING PHOTOSENSITIVE DRUMS BASED ON SHEET INTERVAL BETWEEN TWO SHEETS

CROSS REFERENCE TO RELATED APPLICATION

This application claims priority from Japanese Patent Application No. 2019-205425 filed Nov. 13, 2019. The entire content of the priority application is incorporated herein by reference.

TECHNICAL FIELD

The present disclosure relates to an image forming apparatus including a plurality of photosensitive drums and a plurality of developing rollers.

BACKGROUND

There has been known an image forming apparatus including a plurality of photosensitive drums and a plurality of developing rollers that can contact and separate from the corresponding photosensitive drums. For performing color printing, the plurality of developing rollers is sequentially brought into contact with the corresponding photosensitive drums. For performing monochromatic printing, only one of the developing rollers is brought into contact with the corresponding photosensitive drum. Such technology is described in Japanese Patent Application Publication No. 2012-128017.

SUMMARY

In the above-described image forming apparatus in which a toner image is formed on the photosensitive drum by bringing the developing roller into contact with the photosensitive drum, it is desirable that a time period of contact between the developing roller and the photosensitive drum is as short as possible in order to prolong service life of toner, the developing rollers, and other components. It is particularly desirable to shorten a time period of contact between the developing roller whose usage frequency is high (e.g., the developing roller which is used both for color printing and monochromatic printing) and the corresponding photosensitive drum.

In view of the foregoing, it is an object of the disclosure to provide an image forming apparatus capable of shorten a time period of contact between a developing roller whose usage frequency is high and a corresponding photosensitive drum.

In order to attain the above and other objects, according to one aspect, the present disclosure provides an image forming apparatus including a first photosensitive drum, a second photosensitive drum, a first developing roller, a second developing roller, a first moving mechanism, a second moving mechanism, and a controller. The first developing roller is movable between: a first contact position in which the first developing roller is in contact with the first photosensitive drum; and a first separated position in which the first developing roller is separated from the first photosensitive drum. The second developing roller is movable between: a second contact position in which the second developing roller is in contact with the second photosensitive drum; and a second separated position in which the second developing roller is separated from the second photosensitive drum. The first moving mechanism is configured to move the first developing roller between the first contact position and the first separated position. The second moving mechanism is configured to move the second developing roller between the second contact position and the second separated position. The controller is configured to execute: color printing in which an image is formed on a sheet using the first developing roller and the second developing roller; and monochromatic printing in which an image is formed on a sheet using only the second developing roller. The controller is configured to perform, in a case where the color printing is to be performed on both a first sheet and a second sheet following the first sheet, when a sheet interval that is an interval between the first sheet and the second sheet in a conveying direction of the sheet is shorter than a first interval and is longer than or equal to a second interval that is shorter than the first interval: controlling the first moving mechanism to maintain the first developing roller at the first contact position even after the first developing roller completes development on the first photosensitive drum of an image to be transferred to the first sheet; controlling the first developing roller maintained at the first contract position to start development on the first photosensitive drum of an image to be transferred to the second sheet; controlling the second moving mechanism to: move the second developing roller from the second contact position to the second separated position after the second developing roller completes development on the second photosensitive drum of an image to be transferred to the first sheet; and move the second developing roller again to the second contact position in conformance with a conveyance of the second sheet; and after the second developing roller is moved again to the second contact position, controlling the second developing roller to start development on the second photosensitive drum of an image to be transferred to the second sheet.

According to another aspect, the present disclosure provides an image forming apparatus including a plurality of first photosensitive drums, a second photosensitive drum, a plurality of first developing rollers, a second developing roller, a first moving mechanism, a second moving mechanism, and a controller. The plurality of first developing rollers is provided in one-to-one correspondence with the plurality of first photosensitive drums, each of the plurality of first developing rollers being movable between: a first contact position in which the first developing roller is in contact with the corresponding first photosensitive drum; and a first separated position in which the first developing roller is separated from the corresponding first photosensitive drum. The second developing roller is movable between: a second contact position in which the second developing roller is in contact with the second photosensitive drum; and a second separated position in which the second developing roller is separated from the second photosensitive drum. The first moving mechanism is configured to move each of the plurality of first developing rollers between the first contact position and the first separated position. The second moving mechanism is configured to move the second developing roller between the second contact position and the second separated position. The controller is configured to execute: color printing in which an image is formed on a sheet using the plurality of first developing rollers and the second developing roller; and monochromatic printing in which an image is formed on a sheet using only the second developing roller. The controller is configured to perform, in a case where the color printing is to be performed on both a first sheet and a second sheet following the first sheet, when a sheet interval that is an interval between the first sheet and the second sheet in a conveying direction of the sheet is shorter than a first interval and is longer than or equal to a second interval that is shorter than the first interval: controlling the first moving mechanism to maintain each of the plurality of first developing rollers at the first contact position even after the first developing roller completes development on the corresponding first photosensitive drum of an image to be transferred to the first sheet; controlling each of the plurality of first developing rollers maintained at the first contract positions to start development on the corresponding first photosensitive drum of an image to be transferred to the second sheet; controlling the second moving mechanism to: move the second developing roller from the second contact position to the second separated position after the second developing roller completes development on the second photosensitive drum of an image to be transferred to the first sheet; and move the second developing roller again to the second contact position in conformance with a conveyance of the second sheet; and after the second developing roller is moved again to the second contact position, controlling the second developing roller to start development on the second photosensitive drum of an image to be transferred to the second sheet.

According to still another aspect, the present disclosure provides an image forming apparatus including three first photosensitive drums, a single second photosensitive drum, three first developing rollers, a single second developing roller, a first moving mechanism, a second moving mechanism, and a controller. The three first developing rollers are provided in one-to-one correspondence with the three first photosensitive drums, each of the three first developing rollers being movable between: a first contact position in which the first developing roller is in contact with the corresponding first photosensitive drum; and a first separated position in which the first developing roller is separated from the corresponding first photosensitive drum. The single second developing roller are provided for the single second photosensitive drum, the single second developing roller being movable between: a second contact position in which the single second developing roller is in contact with the single second photosensitive drum; and a second separated position in which the single second developing roller is separated from the single second photosensitive drum. The first moving mechanism is configured to move each of the three first developing rollers between the first contact position and the first separated position. The second moving mechanism is configured to move the single second developing roller between the second contact position and the second separated position. The controller is configured to execute: color printing in which an image is formed on a sheet using the three first developing roller and the single second developing roller; and monochromatic printing in which an image is formed on a sheet using only the single second developing roller. The controller is configured to perform, in a case where the color printing is to be performed on both a first sheet and a second sheet following the first sheet, when a sheet interval that is an interval between the first sheet and the second sheet in a conveying direction of the sheet is shorter than a first interval and is longer than or equal to a second interval that is shorter than the first interval: controlling the first moving mechanism to maintain each of the three first developing rollers at the first contact position even after the first developing roller completes development on the corresponding first photosensitive drum of an image to be transferred to the first sheet; controlling each of the three first developing rollers maintained at the first contract positions to start development on the corresponding first photosensitive drum of an image to be transferred to the second sheet; controlling the second moving mechanism to: move the single second developing roller from the second contact position to the second separated position after the single second developing roller completes development on the single second photosensitive drum of an image to be transferred to the first sheet; and move the single second developing roller again to the second contact position in conformance with a conveyance of the second sheet; and after the single second developing roller is moved again to the second contact position, controlling the single second developing roller to start development on the single second photosensitive drum of an image to be transferred to the second sheet.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Figure 1:
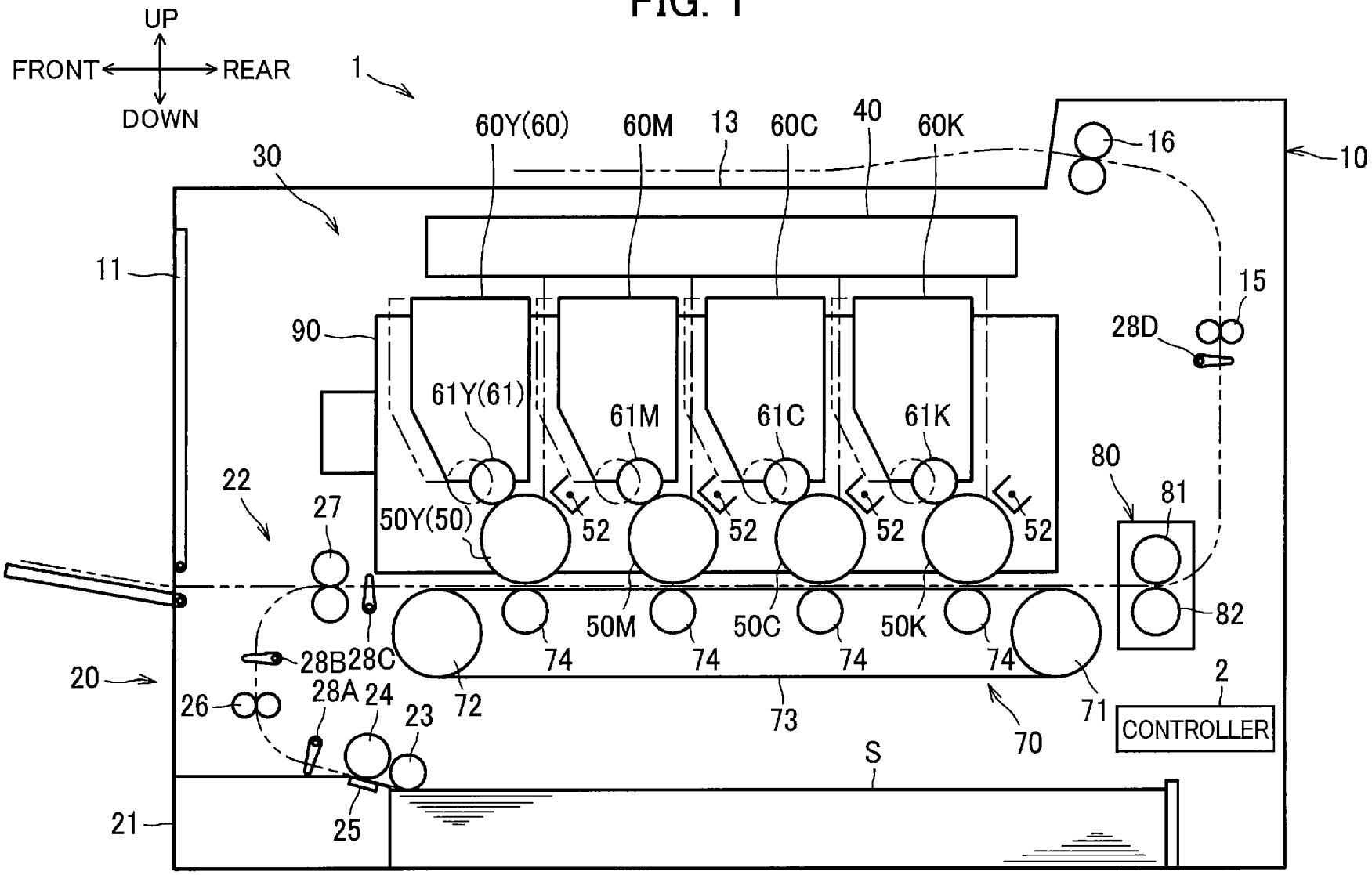
FIG. 1 is a schematic view of an image forming apparatus according to one embodiment.

An image forming apparatus 1 according to one embodiment will be described with reference to FIGS. 1 through 11. The image forming apparatus 1 is a color printer and includes a housing 10, a sheet supply unit 20, an image forming unit 30, and a controller 2.

Note that, throughout the specification, the left side, the right side, the upper side, and the lower side in FIG. 1 will be referred to as the front side, the rear side, the upper side, and the lower side of the image forming apparatus 1, respectively. Further, the near side and the far side in FIG. 1 will be referred to as the right side and the left side of the image forming apparatus 1, respectively.

The housing 10 is formed with a front opening, and includes a front cover 11 that can open and close the front opening. Further, the housing 10 has an upper end portion functioning as a discharge tray 13.

The sheet supply unit 20 includes a sheet tray 21 on which sheets S are mounted, and a sheet supply mechanism 22 configured to supply a sheet S from the sheet tray 21 toward the image forming unit 30. The sheet tray 21 is positioned below the image forming unit 30. The sheet tray 21 is detachable from the housing 10 by pulling the sheet tray 21 frontward out of the housing 10.

The sheet supply mechanism 22 includes a sheet supply roller 23, a separation roller 24, a separation pad 25, a conveyer roller 26, and a registration roller 27. The sheet S is available as an image recording medium on which image can be formed by the image forming apparatus 1. Examples of the sheet S includes plain paper, an envelope, post card, thin paper, thick paper, glossy paper, resin sheet, a seal, and the like.

The sheet(s) S accommodated in the sheet tray 21 is fed by the sheet supply roller 23, then is separated one by one by the separation roller 24 and the separation pad 25, and is conveyed toward the registration roller 27 by the conveyer roller 26. Thereafter, the position of the leading edge of the sheet S is regulated by the registration roller 27 whose rotation is stopped, and then, the sheet S is supplied to the image forming unit 30 by rotation of the registration roller 27.

The image forming apparatus 1 includes a sheet supply sensor 28A, a pre-registration sensor 28B, and a post-registration sensor 28C. These sensors 28A, 28B, 28C are positioned upstream of an array of a plurality of photosensitive drums 50 in a conveying direction of the sheet S. These sensors 28A, 28B, and 28C are configured to detect the passage of a sheet S therethrough.

The sheet supply sensor 28A is positioned downstream of the sheet supply roller 23 and the separation roller 24 in the conveying direction of the sheet S. The pre-registration sensor 28B is positioned downstream of the sheet supply sensor 28A and the conveyer roller 26 and upstream of the registration roller 27 in the conveying direction of the sheet S. The post-registration sensor 28C is positioned downstream of the registration roller 27 and upstream of a Y photosensitive drum 50Y in the conveying direction of the sheet S. The Y photosensitive drum 50Y is the most upstream photosensitive drum 50 of the plurality of photosensitive drums 50.

The image forming unit 30 includes an exposure unit 40, the plurality of photosensitive drums 50, a plurality of developing cartridges 60, a conveying unit 70, and a fixing unit 80. The exposure unit 40 includes a laser diode, a deflector, lenses, and mirrors which are not illustrated. The exposure unit 40 is configured to irradiate a plurality of laser beams as indicated by dotted chain lines in FIG. 1 to thereby expose surfaces of the plurality of photosensitive drums 50 to light.

The plurality of photosensitive drums 50 includes the Y photosensitive drum 50Y for a color of yellow, an M photosensitive drum 50M for a color of magenta, a C photosensitive drum 50C for a color of cyan, and a K photosensitive drum 50K for a color of black. In the present embodiment, each of the Y photosensitive drum 50Y, the M photosensitive drum 50M, and the C photosensitive drum 50C is an example of the first photosensitive drum, and the K photosensitive drum 50K is an example of the second photosensitive drum.

Throughout the specification and drawings, in a case where colors must be distinguished, members or components corresponding to the colors of yellow, magenta, cyan and black are designated by adding "Y", "M", "C", "K", respectively. On the other hand, in a case where distinction of colors is unnecessary, the addition of "Y", "M", "C", "K" is omitted.

The K photosensitive drum 50K is positioned downstream of the Y photosensitive drum 50Y, the M photosensitive drum 50M, and the C photosensitive drum 50C in the conveying direction of the sheet S. The C photosensitive drum 50C is positioned downstream of the Y photosensitive drum 50Y and the M photosensitive drum 50M in the conveying direction of the sheet S. The M photosensitive drum 50M is positioned downstream of the Y photosensitive drum 50Y in the conveying direction of the sheet S. That is, the Y photosensitive drum 50Y, the M photosensitive drum 50M, the C photosensitive drum 50C, and the K photosensitive drum 50K are arrayed in this order from the upstream side to the downstream side in the conveying direction of the sheet S.

The plurality of developing cartridges 60 are provided in one-to-one correspondence to the plurality of photosensitive drums 50. The plurality of developing cartridges 60 includes a Y developing cartridge 60Y, an M developing cartridge 60M, a C developing cartridge 60C, and a K developing cartridge 60K.

The Y developing cartridge 60Y includes a Y developing roller 61Y configured to supply toner to the Y photosensitive drum 50Y. The M developing cartridge 60M includes an M developing roller 61M configured to supply toner to the M photosensitive drum 50M. The C developing cartridge 60C includes a C developing roller 61C configured to supply toner to the C photosensitive drum 50C. The K developing cartridge 60K includes a K developing roller 61K configured to supply toner to the K photosensitive drum 50K.

The Y developing roller 61Y, the M developing roller 61M, the C developing roller 61C, and the K developing roller 61K are arrayed in this order from the upstream side to the downstream side in the conveying direction of the sheet S. Each of the Y developing roller 61Y, the M developing roller 61M, and the C developing roller 61C is an example of the first developing roller, and the K developing roller 61K is an example of the second developing roller.

As illustrated in FIG. 1, each of the developing cartridges 60 is movable between a first position indicated by a solid line and a second position indicated by a virtual line (two-dotted chain line). In a state where the developing cartridge 60 is at the first position, the developing roller 61 is at a contact position where the developing roller 61 is in contact with the corresponding photosensitive drum 50. In a state where the developing cartridge 60 is at the second position, the developing roller 61 is at a separated position in which the developing roller 61 is separated from the corresponding photosensitive drum 50. Therefore, when the developing cartridges 60 moves from the first position to the second position, the developing roller 61 moves from the contact position to the separated position, and when the developing cartridges 60 moves from the second position to the first position, the developing roller 61 moves from the separated position to the contact position.

The plurality of photosensitive drums 50 are rotatably supported by a support member 90 (FIG. 1). The support member 90 is provided with chargers 52 disposed in one-to-one correspondence to the photosensitive drums 50 for charging the corresponding photosensitive drums 50. The support member 90 is attachable to and detachable from the housing 10 through the front opening of the housing 10 in a state where the front cover 11 is open. The support member 90 detachably supports the plurality of developing cartridges 60.

The conveying unit 70 is disposed between the sheet tray 21 and the plurality of photosensitive drums 50. The conveying unit 70 includes a drive roller 71, a driven roller 72, a conveyer belt 73, and four transfer rollers 74. The conveyer belt 73 is an endless belt looped between the drive roller 71 and the driven roller 72 under tension. The conveyer belt 73 has an outer surface facing the photosensitive drums 50. Each of the transfer rollers 74 is disposed inside the loop of the conveyer belt 73 so as to nip the conveyer belt 73 in cooperation with the corresponding photosensitive drum 50.

The fixing unit 80 is disposed rearward of the plurality of photosensitive drums 50 and the conveying unit 70. The fixing unit 80 includes a heat roller 81 and a pressure roller 82 disposed facing the heat roller 81. A sheet discharge sensor 28D, conveying rollers 15, and discharge rollers 16 are disposed downstream of the fixing unit 80 in the conveying direction of the sheet S. The sheet discharge sensor 28D is configured to detect the passage of a sheet S therethrough.

In the image forming unit 30, after the chargers 52 uniformly charge the surfaces of the respective photosensitive drums 50, the surface of each of the photosensitive drums 50 is exposed to light by the light beam irradiated from the exposure unit 40. As a result, an electrostatic latent image corresponding to image data is formed on the surface of each of the photosensitive drums 50. Toner accommodated in each of the developing cartridges 60 is carried on the surface of the developing roller 61 and is supplied from the developing roller 61 that is at the contact position to the electrostatic latent image formed of the corresponding photosensitive drum 50, whereby a toner image is formed on the corresponding photosensitive drum 50.

Then, the toner images on the photosensitive drums 50 are transferred to the sheet S while the sheet S supplied on the conveyer belt 73 is conveyed and passes between the photosensitive drums 50 and the transfer rollers 74, so that. After that, the sheet S passes between the heat roller 81 and the pressure roller 82, so that the toner images are thermally fixed to the sheet S. Thereafter, the sheet S is discharged onto the discharging tray 13 by the conveying rollers 15 and the discharge rollers 16.

Figure 2:
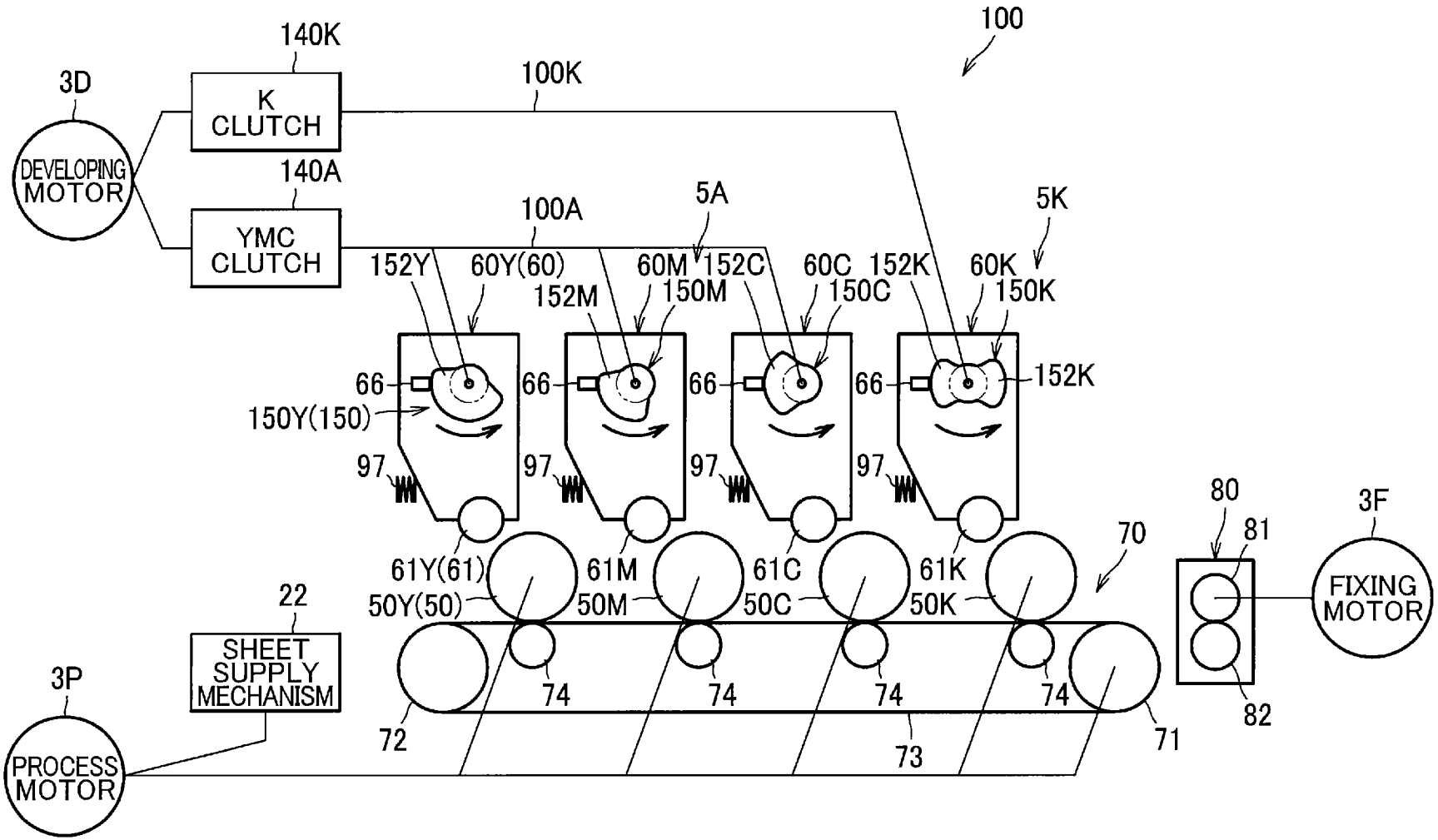
FIG. 2 is a schematic view illustrating a structure for contact and separation of developing rollers relative to corresponding photosensitive drums in the image forming apparatus according to the embodiment.

As illustrated in FIG. 2, the image forming apparatus 1 includes a first moving mechanism 5A and a second moving mechanism 5K. The first moving mechanism 5A is configured to move the three developing rollers 61Y, 61M, 61C between their contact positions and separated positions. The second moving mechanism 5K is configured to move the developing roller 61K between its contact position and separated position.

The first moving mechanism 5A includes a Y cam 150Y, an M cam 150M, and a C cam 150C. The Y cam 150Y is configured to move the Y developing roller 61Y between its contact position and separated position by rotation of the Y cam 150Y. More specifically, rotation of the Y cam 150Y moves the Y developing cartridge 60Y between the first position and the second position to thereby move the Y developing roller 61Y between the contact position and the separated position. The M cam 150M is configured to move the M developing roller 61M between its contact position and separated position by rotation of the M cam 150M. More specifically, rotation of the M cam 150M moves the M developing cartridge 60M between the first position and the second position to thereby move the M developing roller 61M between the contact position and the separated position. The C cam 150C is configured to move the C developing roller 61C between its contact position and separated position by rotation of the C cam 150C. More specifically, rotation of the C cam 150C moves the C developing cartridge 60C between the first position and the second position to thereby move the C developing roller 61C between the contact position and the separated position.

The second moving mechanism 5K includes a K cam 150K. The K cam 150K is configured to move the K developing roller 61K between its contact position and separated position by rotation of the K cam 150K. More specifically, rotation of the K cam 150K moves the K developing cartridge 60K between the first position and the second position to thereby move the K developing roller 61K between the contact position and the separated position. Each of the Y cam 150Y, the M cam 150M and the C cam 150C is an example of the first cam, and the K cam 150K is an example of the second cam.

An example of the structure including the cams 150 and bringing the developing rollers 61 into contact with the corresponding photosensitive drums 50 and separating the developing rollers 61 from the corresponding photosensitive drums 50 will be described.

The support member 90 (see FIG. 1) is configured to support the developing cartridges 60 such that the developing cartridges 60 are movable in a direction in which the plurality of the photosensitive drums 50 are arrayed, that is, in a conveying direction in which the sheet S is conveyed on the conveyer belt 73. Accordingly, each of the developing cartridges 60 is movable between the first position and the second position while being supported by the support member 90.

As illustrated in FIG. 2, the support member 90 includes a plurality of springs 97 provided in one-to-one correspondence with the developing cartridges 60. Each of the springs 97 urges the corresponding developing cartridge 60 from the upstream side to downstream side in the conveying direction of the sheet S.

Each of the developing cartridges 60A includes a pressure receiving portion 66. The pressure receiving portion is disposed on a side surface of the developing cartridge 60 and protrudes in a direction parallel to a rotation axis direction in which the rotation axis of the developing roller 61 extends.

When the cam 150 presses the pressure receiving portion 66 from the downstream side toward the upstream side in the conveying direction of the sheet S, the developing cartridge 60 is moved from the first position to the second position against the urging force of the spring 97, whereby the developing roller 61 is moved from the contact position to the separated position. When the pressing force applied to the pressure receiving portion 66 from the cam 150 is released, the developing cartridge 60 is moved from the second position to the first position by the urging force of the spring 97, whereby the developing roller 61 is moved from the separated position to the contact position.

Each of the cams 150 is rotatable about an axis parallel to the rotation axis of the developing roller 61. The Y cam 150Y has an outer surface on which a cam crest 152Y is provided, the M cam 150M has an outer surface on which a cam crest 152M is provided, and the C cam 150C has an outer surface on which a cam crest 152C is proved. The K cam 150K has an outer surface on which two cam crests 152K symmetrical with each other are provided.

Each of the cam crests 152Y, 152M, 152C, and 152K is configured to press the pressure receiving portion 66 of the corresponding developing cartridge 60. Each of the developing rollers 61 is at the separated position in a state where the pressure receiving portion 66 is pressed by the corresponding one of the cam crests 152Y, 152M, 152C, and 152K. On the other hand, each of the developing rollers 61 is at the contact position in a state where the pressing force applied to the pressure receiving portion 66 from the corresponding one of the cam crests 152Y, 152M, 152C, and 152K is released.

The M cam 150M and the C cam 150C have identical configuration to each other. On the other hand, the length of the cam crest 152Y of the Y cam 150Y in its rotational direction is greater than both the length of the cam crest 152M of the M cam 150M in its rotational direction and the length of the cam crest 152C of the C cam 150C in its rotational direction. The length of each of the cam crests 152K of the K cam 150K in its rotational direction is shorter than any of the length of the cam crest 152Y of the Y cam 150Y in its rotational direction, the length of the cam crest 152M of the M cam 150M in its rotational direction, and the length of the cam crest 152C of the C cam 150C in its rotational direction. All the cams 150 rotate at approximately the same rotation speed, and periods of time required for the cams 150 to make one revolution (rotate one time) are approximately the same period of time TR.

Figure 3:
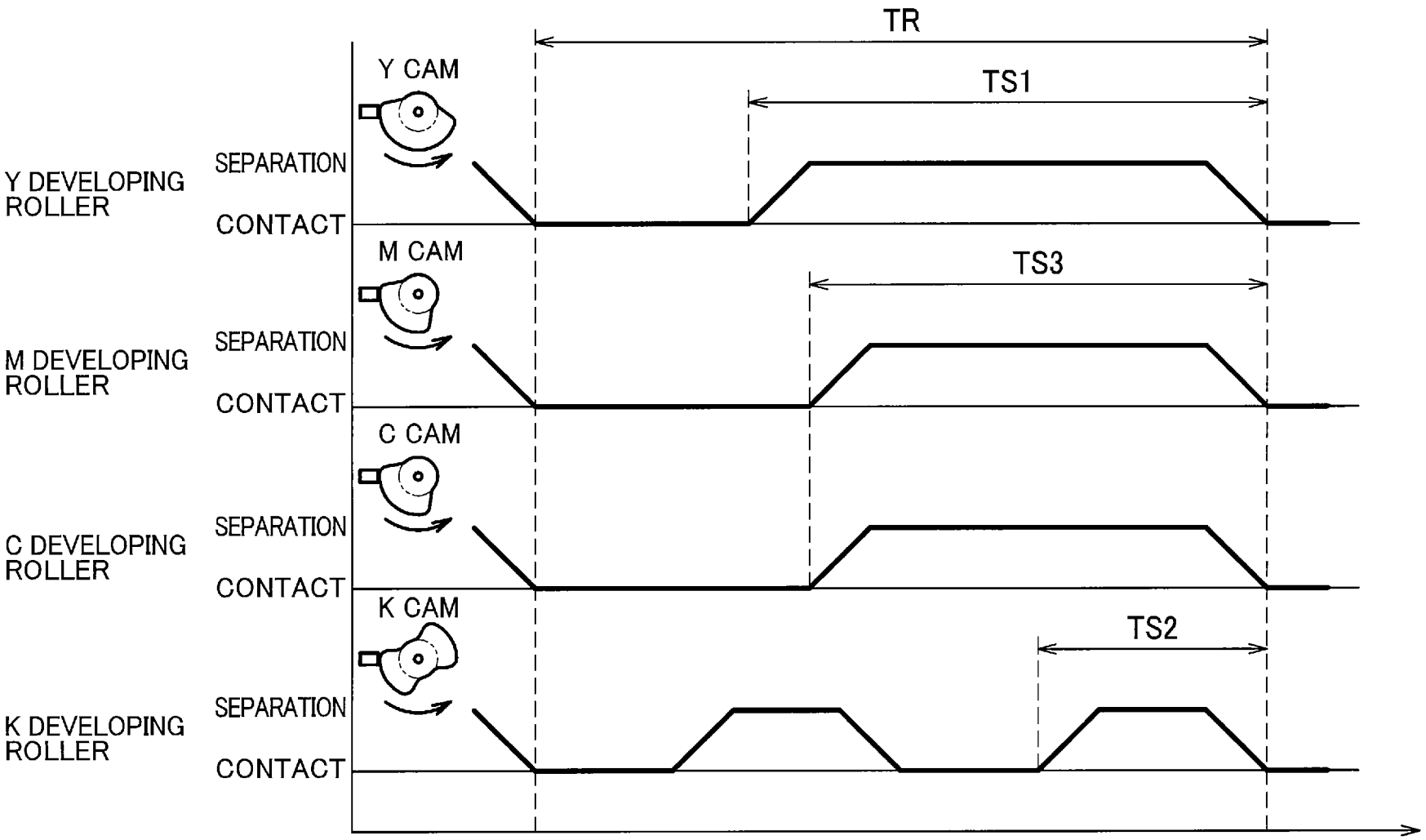
FIG. 3 is a view for description of the profiles of a Y cam, a M cam, a C cam, and a K cam in the image forming apparatus according to the embodiment.
Figure 4A:
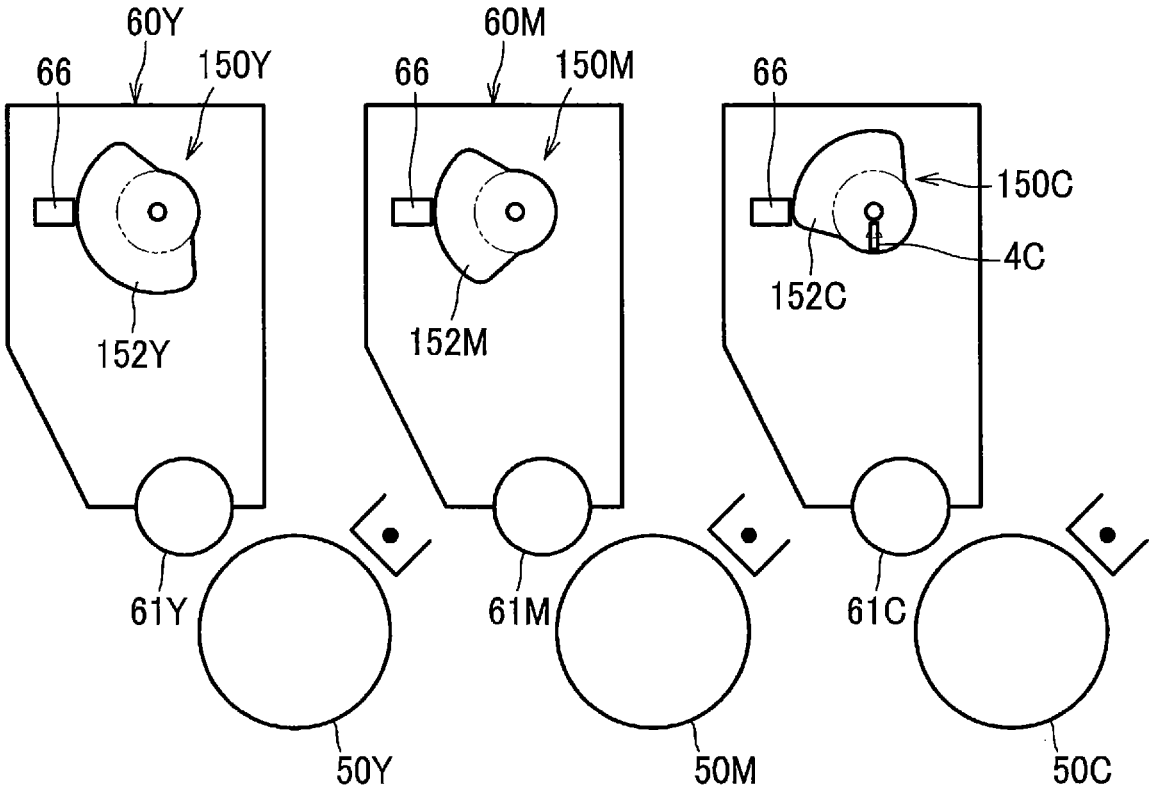
FIG. 4A is a schematic view for description of the phases of the Y cam, M cam, and the C cam in the image forming apparatus according to the embodiment.
Figure 4B:
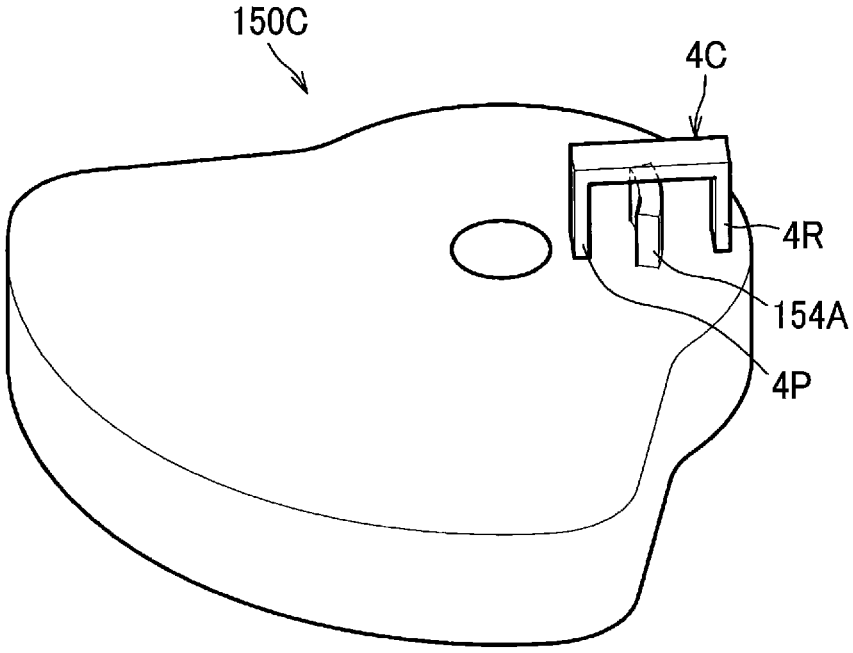
FIG. 4B is a perspective view of a separation sensor for cyan, the C cam, and a first detected in the image forming apparatus according to the embodiment.
Figure 5A:
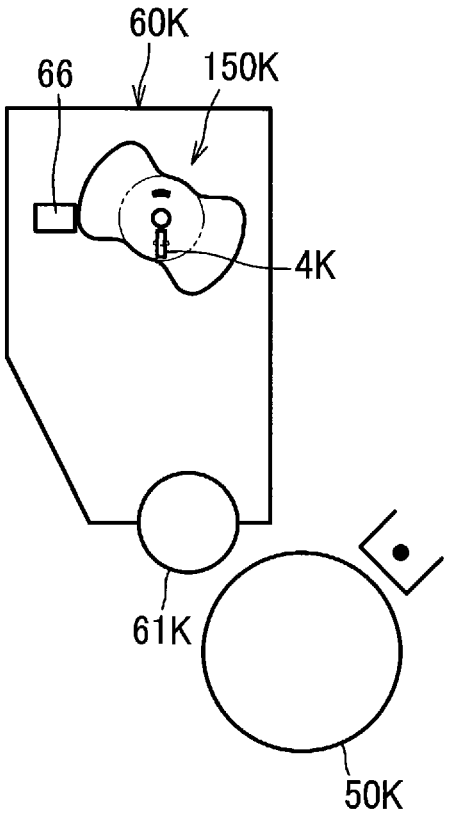
FIG. 5A is a schematic view illustrating the phase of the K cam.
Figure 5B:
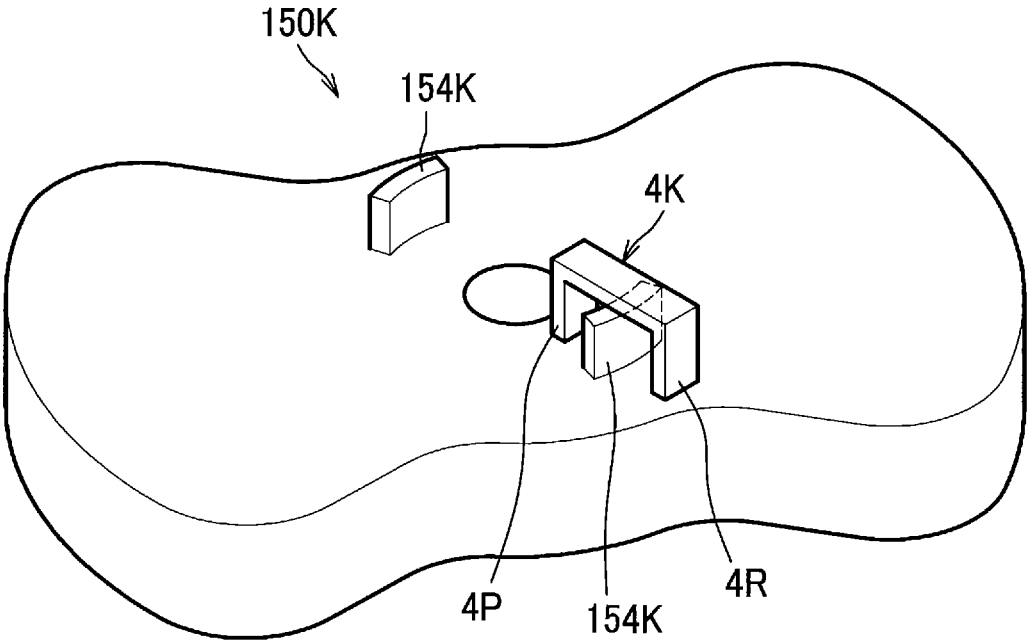
FIG. 5B is a perspective view of a separation sensor for black, the K cam, and second detected portions in the image forming apparatus according to the embodiment.

As such, as illustrated in FIG. 3, a first separation time period TS1 of the Y cam 150Y is longer than a second separation time period TS2 of the K cam 150K, and the second separation time period TS2 of the K cam 150K is shorter than a third separation time period TS3 of each of the M cam 150M and the C cam 150C. Further, the third separation time period TS3 is shorter than the first separation time period TS1.

The first separation time period TS1 is a period of time from a timing at which the Y developing roller 61Y at the contact position starts separating from the Y photosensitive drum 50Y by a continuous rotation of the Y cam 150Y to a timing at which the Y developing roller 61Y again contacts the Y photosensitive drum 50Y by the continuous rotation of the Y cam 150Y. The second separation time period TS2 is a period of time from a timing at which the K developing roller 61K at the contact position starts separating from the K photosensitive drum 50K by a continuous rotation of the K cam 150K to a timing at which the K developing roller 61K again contacts the K photosensitive drum 50K by the continuous rotation of the K cam 150K. The third separation time TS3 is a period of time from a timing at which the M developing roller 61M and the C developing roller 61C at their contact positions start separating from the corresponding photosensitive drums 50M and 50C by continuous rotations of the corresponding cams 150M and 150C to a timing at which the developing roller 61M and 61C again contact the corresponding photosensitive drums 50M and 50C by the continuous rotations of the corresponding cams 150M and 150C. Each of the first separation time period TS1 and the third separation time TS3 is an example of the first time period, and the second separation time period TS2 is an example of the second time period.

Turning back to FIG. 2, the image forming apparatus 1 includes a developing motor 3D, a process motor 3P, a fixing motor 3F, and a power transmission mechanism 100. The power transmission mechanism 100 is configured to transmit driving force of the developing motor 3D to the cams 150. The process motor 3P is a drive source for the sheet supplying mechanism 22, the plurality of photosensitive drums 50, and the drive roller 71 of the conveying unit 70. The fixing motor 3F is a drive source for the heat roller 81 of the fixing unit 80.

The power transmission mechanism 100 includes a first gear train 100A and a second gear train 100K. The first gear train 100A is configured to transmit the driving force of the developing motor 3D to the Y cam 150Y, the M cam 150M, and the C cam 150C. The second gear train 100K is configured to transmit the driving force of the developing motor 3D to the K cam 150K. The Y cam 150Y, the M cam 150M, and the C cam 150C are mechanically connected to each other via gears and are driven to rotate concurrently with each other by receiving the driving force from the developing motor 3D.

A YMC clutch 140A is provided in the middle of the first gear train 100A. The YMC clutch 140A is an electromagnetic clutch, and is switchable between a power transmittable state and a cut-off state. In the power transmittable state, the YMC clutch 140A engages power transmission from the developing motor 3D to the cams 150Y, 150M, 150C, that is, the YMC clutch 140A can transmit the driving force of the developing motor 3D to the cams 150Y, 150M, and 150C. In the cut-off state, the YMC clutch 140A disengages the power transmission from the developing motor 3D to the cams 150Y, 150M, and 150C, that is, the YMC clutch 140A does not transmit the driving force of the developing motor 3D to the cams 150Y, 150M, and 150C.

A K clutch 140K is provided in the middle of the second gear train 100K. The K clutch 140K is an electromagnetic clutch, and is switchable between a power transmittable state and a cut-off state. In the power transmittable state, the K clutch 140K engages power transmission from the developing motor 3D to the K cam 150K, that is, the K clutch 140K can transmit the driving force of the developing motor 3D to the K cam 150K. In the cut-off state, the K clutch 140K disengages the power transmission from the developing motor 3D to the K cam 150K, that is, the K clutch 140K does not transmit the driving force of the developing motor 3D to the K cam 150K.

Hereinafter, operation of switching the YMC clutch 140A to the power transmittable state will be sometimes described as "turning on the YMC clutch 140A", while operation of switching the YMC clutch 140A to the cut-off state will be sometimes described as "turning off the YMC clutch 140A". The same applies to the K clutch 140K.

Although not illustrated, the driving force of the developing motor 3D is also transmitted to each developing roller 61 for rotating the same. Specifically, during movement of the developing roller 61 from the separated position to the contact position and prior to contact of the developing roller 61 with the corresponding photosensitive drum 50, the driving force of the developing motor 3D is transmitted to the developing roller 61 and thus the developing roller 61 starts rotating. Further, during movement of the developing roller 61 from the contact position to the separated position and after separation of the developing roller 61 from the corresponding photosensitive drum 50, the transmission of the driving force from the developing motor 3D to the developing roller 61 is cut off and thus the developing roller 61 stops rotating. With this configuration, the developing roller 61 rotates at the contact position and does not rotate at the separated position.

The Y cam 150Y, the M cam 150M, and the C cam 150C are assembled such that the phases (i.e., the angular positions) of the cam crests 152Y, 152M, and 152C are offset from each other by predetermined angles. Specifically, the phases of the upstream ends of the cam crests 152Y and 152M in the rotational direction are equal to each other. On the other hand, the phase of the upstream end of the cam crest 152C in the rotational direction is offset from the phases of the upstream ends of the cam crest 152Y and 152M in the rotational direction by a predetermined angle. Further, the phases of the downstream ends of the cam crests 152Y, 152M, and 152C in the rotational direction are offset from one another by a predetermined angle.

When the controller 2 turns on the YMC clutch 140A to transmit the driving force of the developing motor 3D to the cams 150Y, 150M, and 150C in a state where the Y developing roller 61Y, the M developing roller 61M, and the C developing roller 61C are at their separated positions, the cams 150Y, 150M, and 150C start rotating at the same time. In conformance with the conveyance of a sheet S, the Y cam 150Y starts moving the Y developing roller 61Y from the separated position toward the contact position, at a timing no earlier than the start of moving the Y developing roller 61Y the M cam 150M starts moving the M developing roller 61M from the separated position toward the contact position, and at a timing later than the start of moving the developing roller 61M the C cam 150C starts moving the C developing roller 61C from the separated position toward the contact position.

Specifically, upon the concurrent start of rotations of the cams 150Y, 150M, and 150C from the state where the developing rollers 61Y, 61M, and 61C are at their separated positions, first the Y cam 150Y starts moving the Y developing roller 61Y toward the contact position, at approximately the same time the M cam 150M starts moving the M developing roller 61M toward the contact position, and at a timing later than the start of moving the M developing roller 61M the C cam 150C starts moving the C developing roller 61C toward the contact position. Thus, the Y developing roller 61Y and the M developing roller 61M reach their contact positions at approximately the same time. After the Y developing roller 61Y and the M developing roller 61M reach their contact positions, the C developing roller 61C reaches the contact position.

When the controller 2 turns on the YMC clutch 140A and the driving force is thus transmitted to the cams 150Y, 150M, and 150C from the developing motor 3D in a state where the developing rollers 61Y, 61M, and 61C are at their contact positions, the cams 150Y, 150M, and 150C start rotating at the same time. Subsequently, in conformance with the conveyance of the sheet S, the Y cam 150Y, the M cam 150M, and the C cam 150C respectively start moving the Y developing roller 61Y, the M developing roller 61M, and the C developing roller 61C from their contact positions to their separated positions in this order. Accordingly, the Y developing roller 61Y, the M developing roller 61M, and the C developing roller 61C reach the separated positions in this order.

The K cam 150 rotates independently of the cams 150Y, 150M, and 150C because the rotation of the K cam 150 is controlled by turn-on and turn-off of the K clutch 140K controlled by the controller 2. When color printing is performed using the four developing rollers 61, the controller 2 controls the K cam 150K such that the K cam 150K operates with its phase lagged by a predetermined angle relative to the C cam 150C (i.e., with a phase lag of a predetermined angle relative to the C cam 150C).

Specifically, when the controller 2 turns on the K clutch 140K at a predetermined timing to transmit the driving force of the developing motor 3D to the K cam 150K in a state where the K developing roller 61K is at the separated position, the K cam 150K starts moving the K developing roller 61K from the separated position toward the contact position at a timing later than the start of moving the C developing roller 61C in conformance with the conveyance of a sheet S. Hence, the K developing roller 61K reaches the contact position after the C developing roller 61C reaches the contact position. In the present embodiment, the developing rollers 61Y, 61M, and 61C reach their contact positions before the K developing roller 61K reaches its contact position.

When the controller 2 turns on the K clutch 140K at a predetermined timing to transmit the driving force of the developing motor 3D to the K cam 150K in a state where the K developing roller 61K is at the contact position, the K cam 150K starts moving the K developing roller 61K from the contact position toward the separated position at a timing later than the start of moving the C developing roller 61C in conformance with the conveyance of the sheet S. Hence, the K developing roller 61K reaches the separated position after the C developing roller 61C reaches the separated position. In the present embodiment, the developing rollers 61Y, 61M, and 61C reach their separated positions before the K developing roller 61K reaches its separated position.

As illustrated in FIGS. 4A through 5B, the image forming apparatus 1 includes separation sensors 4C and 4K. The separation sensor 4C is a phase sensor for detecting the phases (i.e., the angular positions) of the cams 150Y, 150M, and 150C. The separation sensor 4K is a phase sensor for detecting the phase (i.e., the angular position) of the K cam 150K. Each of the separation sensors 4C and 4K outputs a separation signal when the corresponding cam 150 is positioned within a predetermined phase range. On the other hand, each of the separation sensors 4C and 4K does not output the separation signal when the corresponding cam 150 is positioned outside of the predetermined phase range.

Each of the separation sensors 4C and 4K includes a light emitting portion 4P and a light receiving portion 4R which is disposed facing the light emitting portion 4P. The light emitting portion 4P is configured to emit detection light. The light receiving portion 4R is configured to receive the detection light from the light emitting portion 4P. Further, the C cam 150C includes a first detected portion 154A protruding from a side surface of the C cam 150C in a rotation axis direction in which the rotation axis of the C cam 150C extends. The K cam 150K includes two second detected portions 154K protruding from a side surface of the K cam 150K in a rotation axis direction in which the rotation axis of the K cam 150K extends.

The first detected portion 154A is disposed at such a position that the first detected portion 154A is detected by the separation sensor 4C at a timing that the C developing roller 61C moves to the separated position from the contact position (i.e., at a timing at which the C developing roller 61C reaches the separated position). Each of the two second detected portions 154K is disposed at such a position that the second detected portion 154K is detected by the separation sensor 4K at a timing that the K developing roller 61K moves to the separated position from the contact position (i.e., at a timing at which the K developing roller 61K reaches the separated position). That is, the two second detected portions 154K are disposed at different positions on the side surface of the K cam 150K such that each time the K developing roller 61K has moved to the separated position from the contact position, the two second detected portions 154K are alternately detected by the separation sensor 4K.

In a state where the first detected portion 154A is positioned between the light emitting portion 4P and the light receiving portion 4R of the separation sensor 4C to block the detection light and the light receiving portion 4R cannot receive the detection light, the separation sensor 4C outputs a signal to the controller 2 On the other hand, in a state where the first detected portion 154A is displaced from the path of the detection light and the light receiving portion 4R can receive the detection light, the separation sensor 4C does not output the signal to the controller 2. The same is true with respect to the separation sensor 4K and the second detected portions 154K. In this way, the separation sensor 4C directly detects the phase of the C cam 150C; however, the separation sensor 4C indirectly detects the phases of the cams 150Y and 150M as well. That is, the separation sensor 4C is configured to detect not only the phase of the C cam 150C but also the phases of the cams 150Y and 150M.

Hereinafter, a state where the separation sensor 4C outputs the signal will be described sometimes as "the separation sensor 4C is in an ON-state". On the other hand, a state where the separation sensor 4C does not output the signal will be described sometimes as "the separation sensor 4C is in an OFF-state". The same is true for the separation sensor 4K and other sensors. Voltage level when the separation sensor 4C outputs the signal may be higher or lower than that when the separation sensor 4C does not output the signal. The same is true for the separation sensor 4K. Further, since the M cam 150M is the same part as the C cam 150M, the M cam 150M includes a portion having the same shape as the first detected portion 154A. However, since the image forming apparatus 1 is provided with no separation sensor corresponding to the M cam 150M, the portion does not function as the detected portion.

The controller 2 is configured to control the operation of the image forming apparatus 1. The controller 2 includes a CPU, a ROM, a RAM, and an input/output portion, and performs various processes by executing program instructions stored in advance. In the present embodiment, on the basis of signals outputted from the sheet supply sensor 28A, the pre-registration sensor 28B, the post-registration sensor 28C, and the separation sensors 4C and 4K, the controller 2 is configured to control the YMC clutch 140A, the K clutch 140K, and the like to control the contact and separation of the developing rollers 61 relative to the corresponding photosensitive drums 50.

The controller 2 is configured to perform not only color printing for forming color images on a sheet S using all the developing rollers 61Y, 61M, 61C, and 61K, but also monochromatic printing for forming monochromatic images on a sheet S using only the K developing roller 61K.

Further, the controller 2 is configured to perform, in a case where color printing is performed both on a first sheet S and a second sheet S printed next thereto, the following operation on the basis of a sheet interval of the two sheets. Here, the terms "sheet interval" denotes a distance between the trailing edge of a preceding sheet (i.e., the upstream edge of the first sheet S) and the leading edge of a subsequent sheet (i.e., the downstream edge of the second sheet S) in the conveying direction of the sheet S.

More specifically, in a case where color printing is performed both on a first sheet S (a preceding sheet S) and a second sheet S (a subsequent sheet S) printed next thereto, the controller 2 performs different operations for three cases: a case where the sheet interval is long, a case where the sheet interval is short, and a case where the sheet interval is middling.

The case where the sheet interval is long means a case where the sheet interval is longer than or equal to a first interval. The first interval is the distance by which the sheet S is conveyed in the first separation time period TS1 described above. In other words, the first interval is the distance by which the sheet S is conveyed in a period of time required for the Y developing roller 61Y to make one round trip by rotation of the Y cam 150Y (i.e., in a period of time required for the Y developing roller 61Y is moved from its contact position to its separated position and is returned again to its contact position by rotation of the Y cam 150Y). The first interval is represented by the expression "Vs×TS1", where "Vs" is the conveying speed at which the sheet S is conveyed and "TS1" is the first separation time period TS1. In a case where the sheet interval is longer than or equal to the first interval, all the developing rollers 61Y, 61M, 61C, and 61K can complete one round trip within a period of time from the completion of their development for the preceding sheet S until the subsequent sheet S reaches the respective developing rollers 61Y, 61M, 61C, and 61K.

The case where the sheet interval is short denotes a case where the sheet interval is shorter than a second interval that is shorter than the first interval. The second interval is the distance by which the sheet S is conveyed in the second separation time period TS2 described above. In other words, the second interval is the distance by which the sheet S is conveyed in a period of time required for the K developing roller 61K to make one round trip by rotation of the K cam 150K (i.e., in a period of time required for the K developing roller 61K is moved from its contact position to its separated position and is returned again to its contact position by rotation of the K cam 150K). The second interval is represented by the expression "Vs×TS2", where "Vs" is the conveying speed at which the sheet S is conveyed and "TS2" is the second separation time period TS2. In a case where the sheet interval is shorter than the second interval, all the developing rollers 61Y, 61M, 61C, and 61K cannot complete one round trip within a period of time from the completion of their development for the preceding sheet S until the subsequent sheet S reaches the respective developing rollers 61Y, 61M, 61C, and 61K. In this case, if the developing rollers 61Y, 61M, 61C, and 61K started one round trip after the completion of their development for the preceding sheet S, the developing rollers 61Y, 61M, 61C, and 61K could not return to their contact positions by the start timing of their development for the subsequent sheet S.

The case where the sheet interval is middling means a case where the sheet interval is shorter than the first interval and longer than or equal to the second interval. In a case where the sheet interval is shorter than the first interval and longer than or equal to the second interval, only the K developing rollers 61K can complete one round trip within a period of time from the completion of its development for the preceding sheet S until the subsequent sheet S reaches the K developing roller 61K. In this case, if the developing rollers 61Y, 61M, and 61C started one round trip after the completion of their development for the preceding sheet S, the developing rollers 61Y, 61M, and 61C could not return to their contact positions by the start timing of their development for the subsequent sheet S.

(1) Case of Long Sheet Interval

In a case where the sheet interval is longer than or equal to a first interval, that is, in a case where the sheet interval is long, the controller 2 controls the first moving mechanism 5A: to move each of the developing rollers 61Y, 61M, and 61C to its separated positions after the completion of its development on the corresponding photosensitive drum 50 of an image to be transferred to the first sheet S; then to again move each of the developing rollers 61Y, 61M, and 61C to its contact position in conformance with the conveyance of the second sheet S; and then to start its development on the corresponding photosensitive drum 50 of an image to be transferred to the second sheet S. Note that "the completion of its development on the corresponding photosensitive drum 50 of an image" with respect to a developing roller denotes that the formation of a toner image corresponding to that image on a photosensitive drum corresponding to that developing roller is completed. For example, "the completion of its development on the corresponding photosensitive drum 50 of an image" with respect to the C developing roller 61C means that the formation of a toner image corresponding to that image on the C photosensitive drum 50C corresponding to the C developing roller 61C is completed.

Further, in addition to the above control, the controller 2 controls the second moving mechanism 5K: to move the developing roller 61K to its separated position after the completion of development of an image to be transferred to the first sheet S; then to again move the developing roller 61K to its contact position in conformance with the conveyance of the second sheet S; and then to start development of an image to be transferred to the second sheet S.

The controller 2 determines that the sheet interval is long in a case where both the post-registration sensor 28C and the sheet supply sensor 28A are not switched to their ON-states at the time that a predetermined time period elapses from a timing at which the post-registration sensor 28C is switched to its OFF-state by the first sheet S having passed through the post-registration sensor 28C. This is because the aforementioned scenario means that the second sheet S has not yet been supplied or fed from the sheet tray 21 although the predetermined time period has elapsed since the passage of the first sheet S through the post-registration sensor 28C.

In a case where the sheet interval is long, the controller 2 rotates the cams 150Y, 150M, and 150C to move the developing rollers 61Y, 61M and 61C from their contact positions to their separated positions, respectively, after the completion of development of images to be transferred to the first sheet S. After that, the controller 2 rotates the cams 150Y, 150M, and 150C to move the developing rollers 61Y, 61M, and 61C again to their contact positions from their separated positions in conformance with the conveyance of the second sheet S, and then starts development of images to be transferred to the second sheet S. Further, the controller 2 rotates the K cam 150K to move the developing roller 61K from its contact position to its separated position after the completion of development of an image to be transferred to the first sheet S. After that, the controller 2 rotates the K cam 150K to move the developing roller 61K again to its contact position from its separated position in conformance with the conveyance of the second sheet S, and then starts development of an image to be transferred to the second sheet S.

(2) Case of Short Sheet Interval

In a case where the sheet interval is shorter than a second interval that is shorter than the first interval, that is, in a case where the interval is short, the controller 2 controls the first moving mechanism 5A to maintain the developing rollers 61Y, 61M and 61C at their contact positions even after the completion of development of images to be transferred to the first sheet S, and then to start development of an image to be transferred to the second sheet S. In addition to this, the controller 2 controls the second moving mechanism 5K to maintain the developing roller 61K at its contact position even after the completion of development of an image to be transferred to the first sheet S, and then to start development of an image to be transferred to the second sheet S.

In the present embodiment, the controller 2 determines that the sheet interval is short in a case where the post-registration sensor 28C is already switched by the detection of the second sheet S to its ON-state at the time that the predetermined time period elapses from a timing at which the post-registration sensor 28C is switched to its OFF-state by the first sheet S having passed through the post-registration sensor 28C. This is because the aforementioned scenario means that the second sheet S has been conveyed and reached the sheet supply sensor 28A (i.e., a position immediately upstream of the Y photosensitive drum 50Y in the conveying direction of the sheet S) at the time that the predetermined time period elapses from the passage of the first sheet S through the post-registration sensor 28C.

In a case where the sheet interval is short, the controller 2 leaves the cams 150Y, 150M, and 150C stopped to maintain the developing rollers 61Y, 61M, and 61C at their contact positions, respectively, even after the completion of development of images to be transferred to the first sheet S. Then, the controller 2 uses the developing rollers 61Y, 61M and 61C maintained at their contact positions to start development of images to be transferred to the second sheet S having been conveyed. Further, the controller 2 leaves the cam 150K stopped to maintain the developing roller 61K at its contact position even after the completion of development of an image to be transferred to the first sheet S. Then, the controller 2 uses the developing roller 61K maintained at its contact position to start development of an image to be transferred to the second sheet S having been conveyed.

(3) Case of Middling Sheet Interval

In a case where the sheet interval is shorter than the first interval and longer than or equal to the second interval, that is, the interval is middling or moderate, the controller 2 controls the first moving mechanism 5A to maintain the developing rollers 61Y, 61M, and 61C at their contact positions even after the completion of development of images to be transferred to the first sheet S, and then to start development of images to be transferred to the second sheet S. On the other hand, in addition to this, the controller 2 controls the second moving mechanism 5K to: move the developing roller 61K to its separated position after the completion of development of an image to be transferred to the first sheet S; then to move the developing roller 61K again to its contact position in conformance with the conveyance of the second sheet S; and then to start development of an image to be transferred to the second sheet S.

In the present embodiment, the controller 2 determines that the sheet interval is middling in a case where, at the time that the predetermined time period elapses from a timing at which the post-registration sensor 28C is switched to its OFF-state by the first sheet S having passed through the post-registration sensor 28C, the post-registration sensor 28C is not switched to its ON-state but the sheet supply sensor 28A is already switched to its ON-state by detecting the second sheet S. This is because the aforementioned scenario means that, at the time of the predetermined time period elapses from a timing at which the post-registration sensor 28C is switched to its OFF-state by the passage of the first sheet S through the post-registration sensor 28C, the second sheet S is already supplied from the sheet tray 21 but the second sheet S has not yet reached the post-registration sensor 28C.

In a case where the sheet interval is middling, the controller 2 leaves the cams 150Y, 150M, and 150C stopped to maintain the developing rollers 61Y, 61M, and 61C at their contact positions, respectively, even after the completion of development of images to be transferred to the first sheet S. Then, the controller 2 uses the developing rollers 61Y, 61M, and 61C maintained at their contact positions to start development of images to be transferred to the second sheet S having been conveyed.

In addition to the above control, the controller 2 rotates the K cam 150K to move the developing roller 61K from its contact position to its separated position after the completion of development of an image to be transferred to the first sheet S. After that, the controller 2 rotates the K cam 150K to move the developing roller 61K again to its contact position from its separated position in conformance with the conveyance of the second sheet S, and then starts development of an image to be transferred to the second sheet S.

Next, a process executed by the controller 2 to perform color printing will be described while referring to the flowcharts illustrated in FIGS. 6 to 8B. Note that, all the developing rollers 61 are at their separated positions prior to the start of printing operation.

Figure 6:
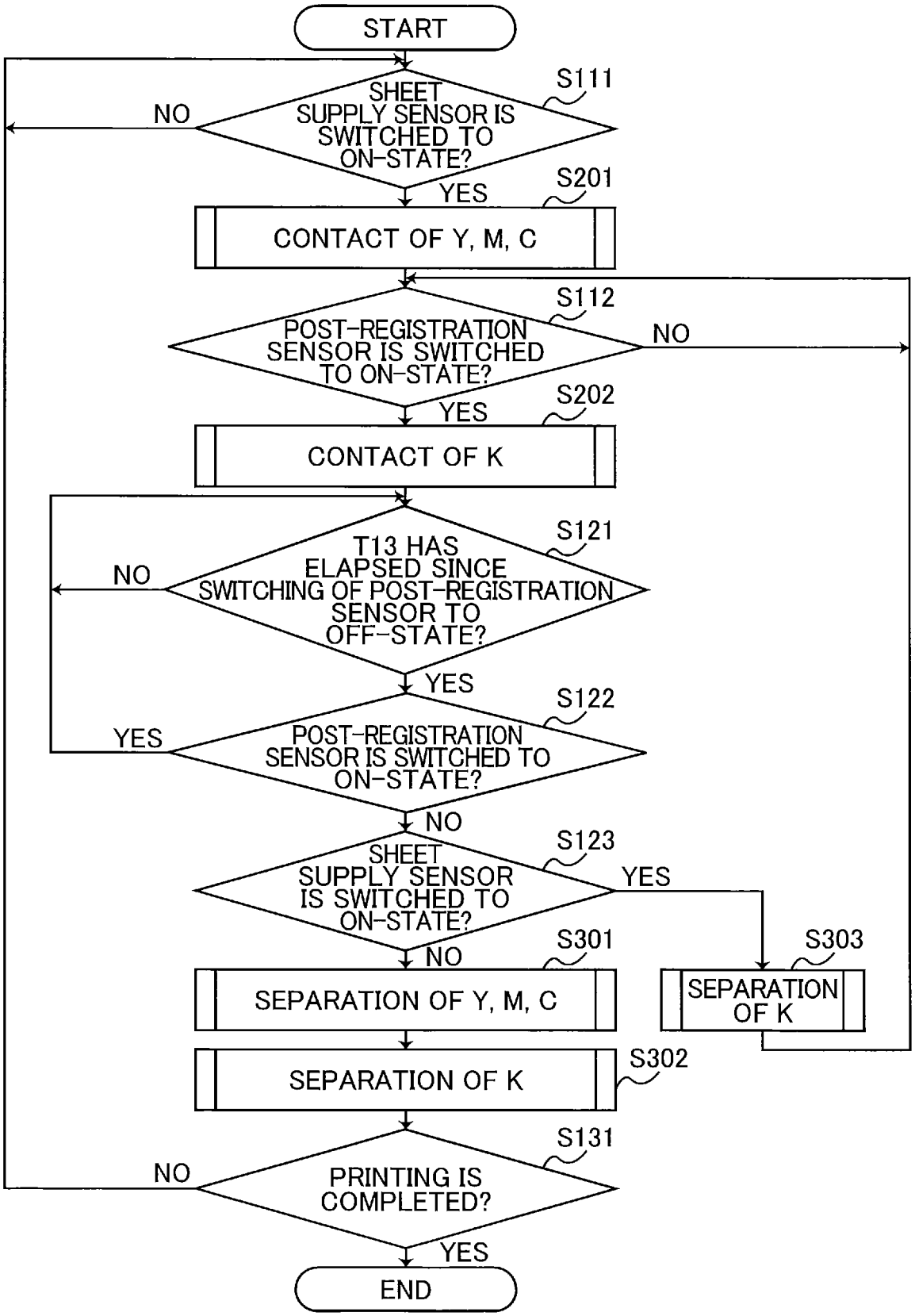
FIG. 6 is a flowchart illustrating an example process executed for color printing by a controller in the image forming apparatus according to the embodiment.

As illustrated in FIG. 6, in response to receiving a print job, the controller 2 determines whether the sheet supply sensor 28A has been switched to its ON-state (S111). Note that, after the print job is received, a sheet S is supplied from the sheet tray 21 and then is detected by the sheet supply sensor 28A, whereby the sheet supply sensor 28A is switched to the ON-state. In a case where the sheet supply sensor 28A is determined to be in the ON-state (S111: Yes), the controller 2 moves the developing rollers 61Y, 61M, and 61C to their contact positions (S201).

Figure 7A:
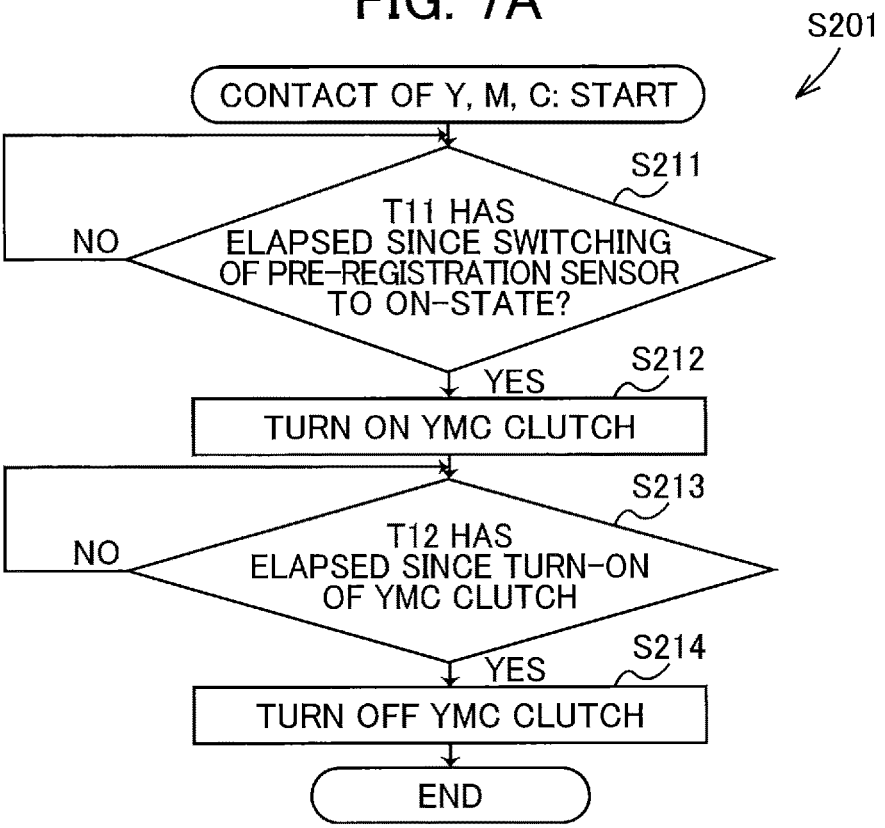
FIG. 7A is a flowchart illustrating an example process for bringing the developing rollers for the colors of yellow, magenta, and cyan into contact with the corresponding photosensitive drums in the image forming apparatus according to the embodiment.

Specifically, as illustrated in FIG. 7A, when a first predetermined time period T11 has elapsed since a timing at which the pre-registration sensor 28B is switched to its ON-state as a result of the detection of the sheet S by the pre-registration sensor 28B, the controller 2 turns on the YMC clutch 140A to rotate the cams 150Y, 150M, and 150C (S211: Yes), whereby the developing rollers 61Y, 61M, and 61C moves from their separated positions to their contact positions. The developing rollers 61Y, 61M, and 61C start performing development in the order of arrival at their contact positions. The first predetermined time period T11 is set to such a time period that the Y developing roller 61Y starts development on the Y photosensitive drum 50Y such that the leading end of a toner image formed on the Y photosensitive drum 50Y by the development and the leading end of the image area (i.e., the area onto which the toner image is to be transferred) of the sheet S reach the transfer portion (i.e., the nip portion between the Y photosensitive drum 50Y and the transfer belt 73) at approximately the same time.

When a second predetermined time period T12 has elapsed since the timing at which the YMC clutch 140A is turned on (S213:Yes), the controller 2 turns off the YMC clutch 140A to stop the rotations of the cams 150Y, 150M, and 150C (S214). The second predetermined time period T12 is set to a time period within which all the developing rollers 61Y, 61M, and 61C can complete their movements to their contact positions.

Further, as illustrated in FIG. 6, the controller 2 determines whether the post-registration sensor 28C has been switched to its ON-state (S112). Note that the post-registration sensor 28C is switched to the ON-state by detecting the sheet S. When the post-registration sensor 28C is determined to be switched to the ON-state (S112: Yes), the controller 2 moves the K developing roller 61K to its contact position (S202).

Figure 7B:
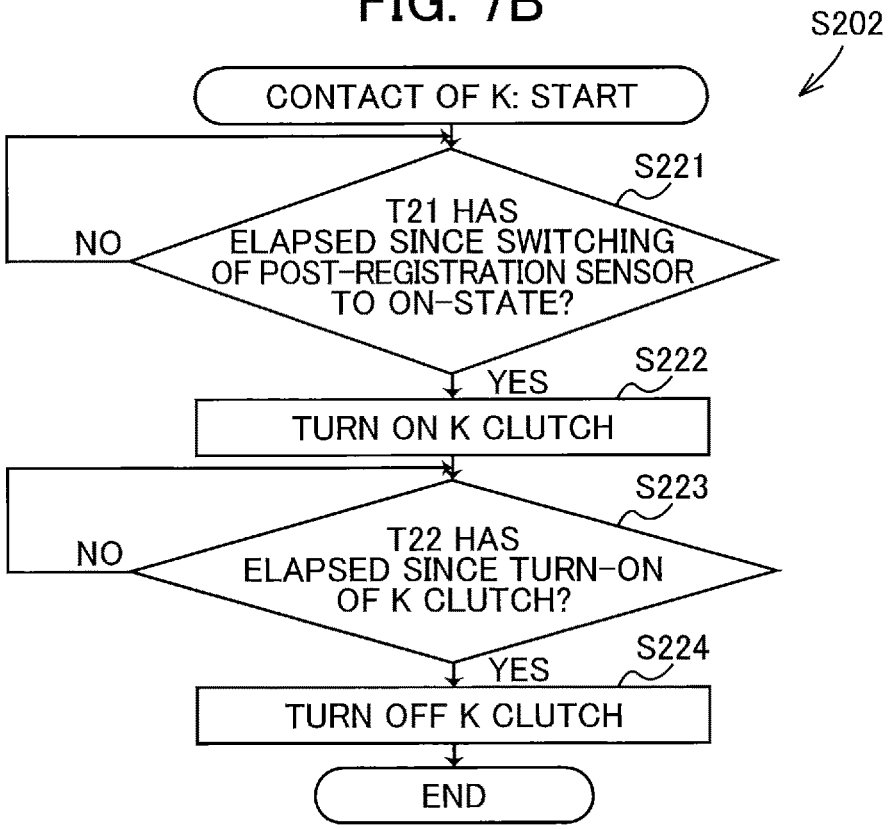
FIG. 7B is a flowchart illustrating an example process for bringing the developing roller for the color of black into contact with the corresponding photosensitive drum in the image forming apparatus according to the embodiment.

Specifically, as illustrated in FIG. 7B, when a first predetermined time period T21 has elapsed since a timing at which the post-registration sensor 28C is switched to its ON-state (S221:Yes), the controller 2 turns on the K clutch 140K (S222) to rotate the K cam 150K. Hence, the K developing roller 61K moves from its separated position to its contact position, and performs development. The first predetermined time period T21 is set to such a time period that development on the K photosensitive drum 50K by the K developing roller 61K can be completed before the start timing of transferring a toner image from the K photosensitive drum 50K onto the sheet S.

When a second predetermined time period T22 has elapsed since the timing at which the K clutch 140K is turned on (S223:Yes), the controller 2 turns off the K clutch 140K to stop the rotation of the K cam 150K (S224). The second predetermined time period T22 is set to a time period within which the K developing roller 61K can complete its movement to the contact position.

Then, as illustrated in FIG. 6, the controller 2 determines whether a third predetermined time period T13 has elapsed since a timing at which the post-registration sensor 28C is switched to the OFF-state as a result of the sheet S having passed through the post-registration sensor 28C (S121). When the third predetermined time period T13 is determined to have elapsed (S121: Yes), the controller 2 determines whether post-registration sensor 28C has been switched to the ON-state as a result of the detection of a subsequent sheet S by the post-registration sensor 28C (S122).

In a case where the post-registration sensor 28C is not determined to be in the ON-state (S122: No), the controller 2 determines whether the sheet supply sensor 28A has been switched to its ON-state as a result of the detection of the subsequent sheet S by the sheet supply sensor 28A (S123). In a case where the sheet supply sensor 28A is not determined to be in the ON-state (S123: No), the sheet interval is long provided that the subsequent sheet S to be printed exists. Therefore, the controller 2 moves the developing rollers 61Y, 61M and 61C to the separated positions (S301), and moves also the K developing roller 61K to the separated position (S302).

Figure 8A:
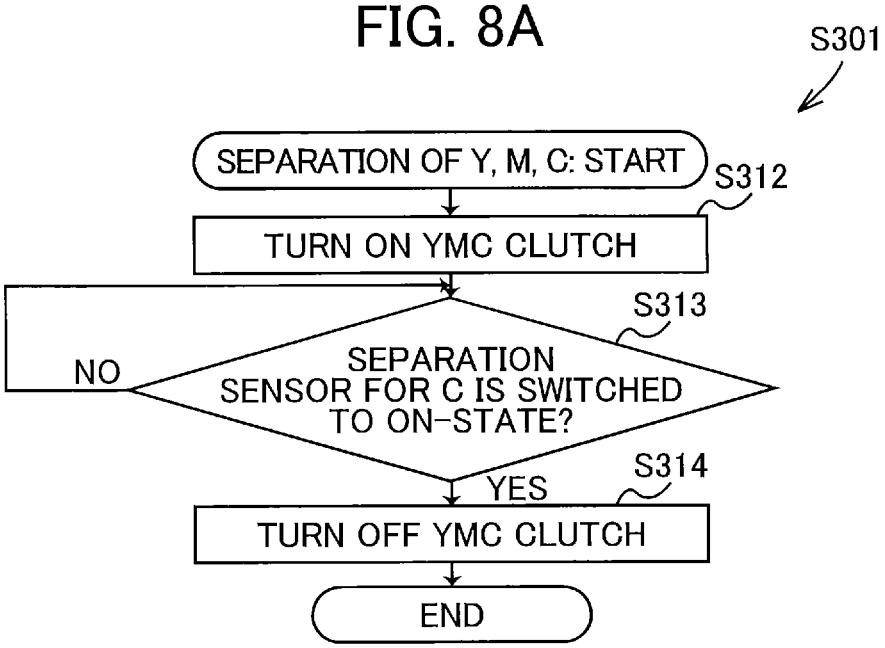
FIG. 8A is a flowchart illustrating an example process for separating the developing rollers for the colors of yellow, magenta, and cyan from the corresponding photosensitive drums in the image forming apparatus according to the embodiment.

Specifically, as illustrated in FIG. 8A, the controller 2 turns on the YMC clutch 140A to rotate the cams 150Y, 150M, and 150C (S312), whereby the developing rollers 61Y, 61M, and 61C moves from the contact positions to the separated positions. The third predetermined time period T13 is set to such a time period that the Y developing roller 61Y can start moving to the separated position after the Y developing roller 61Y completes development on the Y photosensitive drum 50Y.

When the separation sensor 4C for the color of cyan has been switched from its OFF-state to its ON-state (S313: Yes), the controller 2 turns off the YMC clutch 140A (S314) to stop rotation of the cams 150Y, 150M, and 150C.

Figure 8B:
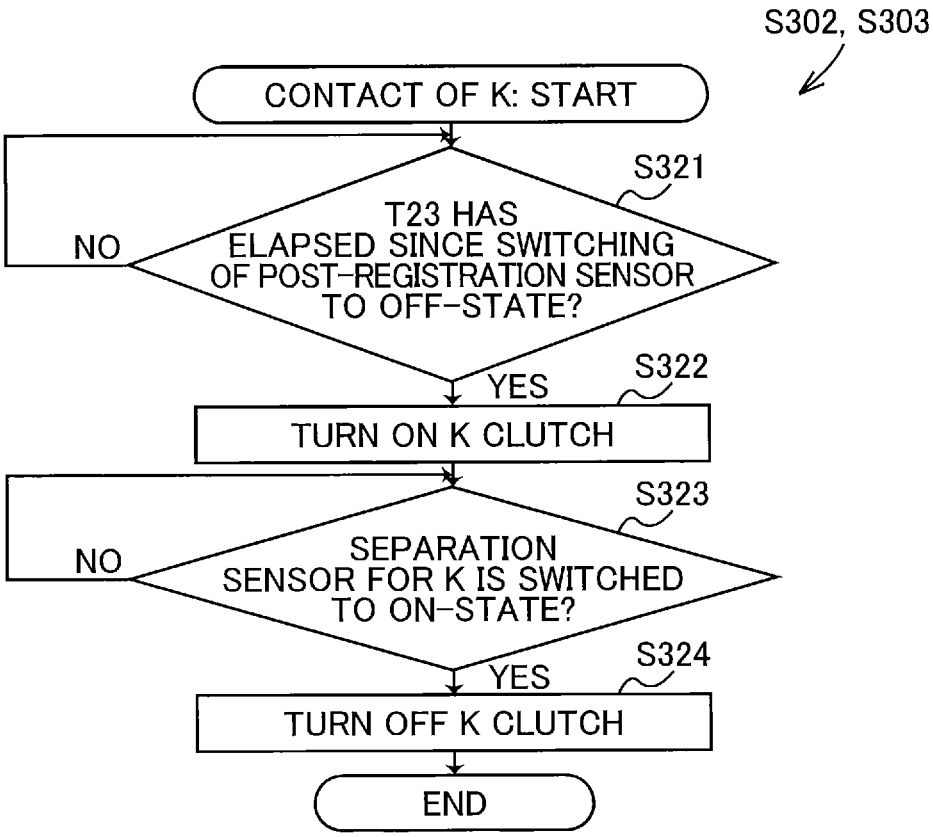
FIG. 8B is a flowchart illustrating an example process for separating the developing roller for the color of black from the corresponding photosensitive drum in the image forming apparatus according to the embodiment.

Further, as illustrated in FIG. 8B, when a third predetermined time period T23 has elapsed since a timing at which the post-registration sensor 28C is switched to its OFF-state by the precedent sheet S having passed through the post-registration sensor 28C (S321: Yes), the controller 2 turns on the K clutch 140K (S322) to rotate the K clutch 140K, moving the K developing roller 61K from its contact position to its separated position. The third predetermined time period T23 is set to such a time period that the K developing roller 61K can start moving to the separated position after the K developing roller 61K completes development on the K photosensitive drum 50K.

When the separation sensor 4K for the color of black has been switched from its OFF-state to its ON-state (S323:Yes), the controller 2 turns off the K clutch K 140K (S324) to stop the rotation of the K cam 150K.

Returning back to FIG. 6, in a case where the post-registration sensor 28C detects the subsequent sheet S and is thus already switched to the ON-state at the time of the determination in S122, i.e., in a case where the post-registration sensor 28C is determined to be in the ON-state (S122: Yes) in S122 of FIG. 6, the sheet interval is short. Therefore, the controller 2 maintains all the developing rollers 61Y, 61M, 61C, and 61K at their contact positions, and then performs development for the subsequent sheet S. After that, step S121 and the steps subsequent thereto are repeated.

Further, in a case where the subsequent sheet S is not detected by the post-registration sensor 28C but is detected by the subsequent sheet S and is already switched to the ON-state at the time of the determination in S123 of FIG. 6, i.e., in a case where the sheet supply sensor 28A is determined to be the ON-state (S123: Yes), the sheet interval is middling. Therefore, the controller 2 maintains the developing rollers 61Y, 61M, and 61C at their contact positions, whereas moves the K developing roller 61K to the separated position (S303) (see FIG. 8B).

Then, when the post-registration sensor 28C is switched to the ON-state as a result of the detection of the subsequent sheet S by the post-registration sensor 28C (S112: Yes), the controller 2 moves the K developing roller 61K to the contact position (S202), and uses the K developing roller 61K as well as the developing rollers 61Y, 61M, and 61C maintained at their contact positions to perform development for the subsequent sheet S. After that, step S121 and the steps subsequent thereto are repeated.

After step S302, the controller 2 determines whether the printing operation has been terminated (S131). In a case where the printing operation has not yet been terminated (S131: No), that is, a subsequent sheet S to print exists, the process is repeated from to S111. In a case where the printing operation has been terminated (S131: Yes), the process is ended.

Figure 9:
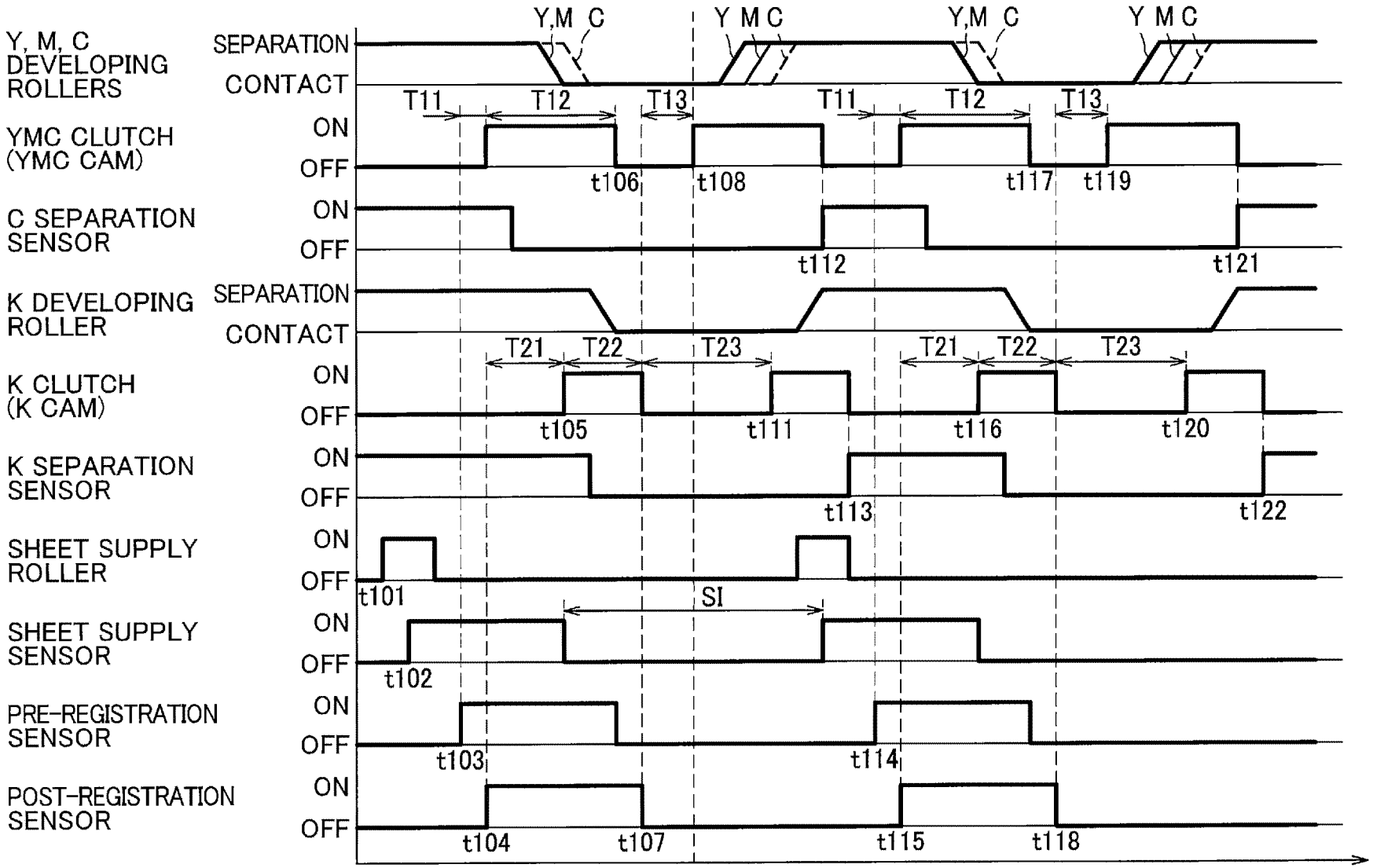
FIG. 9 is a timing chart for description of operation of the developing rollers in a case where a sheet interval is long.
Figure 10:
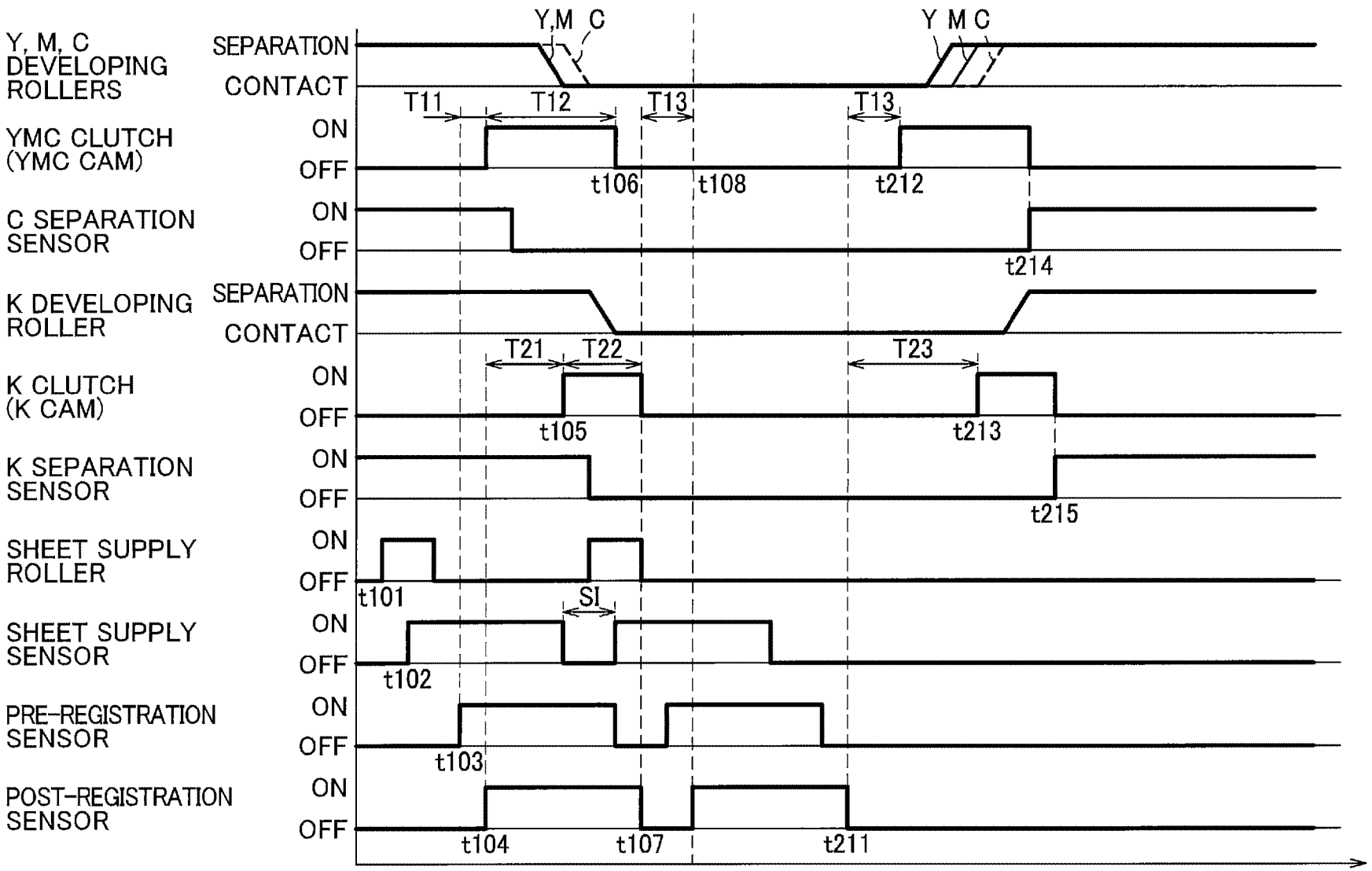
FIG. 10 is a timing chart for description of operation of the developing rollers in a case where the sheet interval is short.
Figure 11:
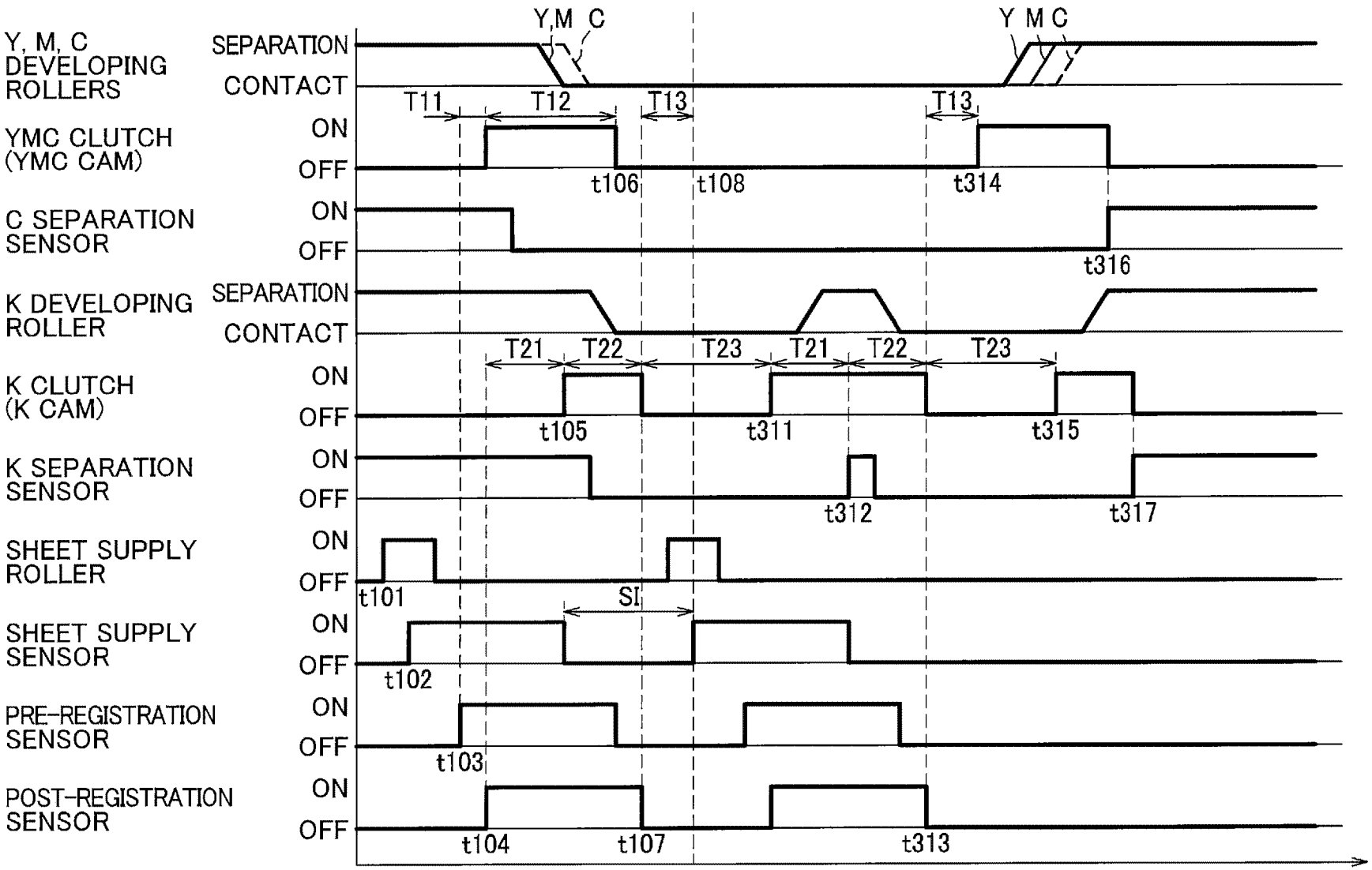
FIG. 11 is a timing chart for description of operation of the developing rollers in a case where the sheet interval is middling.

Next, operation of the developing rollers 61 in the process executed by the controller 2 for performing color printing will be described with reference to timing charts illustrated in FIGS. 9 through 11. FIGS. 9 through 11 illustrate the case where color printing is performed on only the first sheet and the second sheet, that is, the case where the printing process is terminated upon the completion of printing on the second sheet. Note that, in FIGS. 9 through 11, the operation timing of the Y developing roller 61Y is indicated by a bold line, the operation timing of the M developing roller 61M is indicted by a normal line, and operation timing of the C developing roller 61C is indicated by a broken line, and these lines are partly overlapped with each other.

(1) Case of Long Sheet Interval

As illustrated in FIG. 9, after the first sheet S in the sheet tray 21 is pick-up by the sheet supply roller 23 (t101) and then the sheet supply sensor 28A is switched to its ON-state by the first sheet S (t102), the controller 2 turns on the YMC clutch 140A. More specifically, the controller 2 turns on the YMC clutch 140A when the first predetermined time period T11 has elapsed since a timing at which the pre-registration sensor 28B is switched to its ON-state by the first sheet S (t103). Further, when the first predetermined time period T21 has elapsed since a timing at which the post-registration sensor 28C is switched to its ON-state by the first sheet S (t104), the controller 2 turns on the K clutch 140K (t105). By these actions, the developing rollers 61Y, 61M, 61C, and 61K are sequentially moved from their separated positions to their contact positions.

The controller 2 turns off the YMC clutch 140A (t106) when the second predetermined time period T12 has elapses since the timing at which the YMC clutch 140A is turned on. In addition, the controller 2 turns off the K clutch 140K when the second predetermined time period T22 has elapsed since the timing at which the K clutch 140K is turned on (t105).

In a case where, at the time that the third predetermined time period T13 elapses (t108) from a timing at which the post-registration sensor 28C is switched to the OFF-state by the first sheet S having passed through the post-registration sensor 28C (t107), both the post-registration sensor 28C and the sheet supply sensor 28A are not switched to their ON-state because of non-detection of the second sheet S (i.e., both the post-registration sensor 28C and the post-registration sensor 28C are still in their OFF-state because they do not detect the second sheet S), the sheet interval Si is long and accordingly, the controller 2 turns on the YMC clutch 140A. Further, in this case, the controller 2 turns on the K clutch 140K (t111) when the third predetermined time period T23 has elapsed since the timing at which the post-registration sensor 28C is turned off by the first sheet S having passed through the post-registration sensor 28C (t107). By these actions, all the developing rollers 61Y, 61M, 61C, and 61K are sequentially moved from their contact positions to their separated positions.

The controller 2 turns off the YMC clutch 140A when the separation sensor 4C for the color of cyan is switched to its ON-state (t112), and turns off the K clutch 140K when the separation sensor 4K for the color of black is switched to its ON-state (t113).

Then, the controller 2 turns on the YMC clutch 140A when the first predetermined time period T11 has elapsed since a timing at which the pre-registration sensor 28B is switched to the ON-state by the second sheet S (t114). Further, the controller 2 turns on the K clutch 140K (t116) when the first predetermined time period T21 has elapsed since a timing at which the post-registration sensor 28C is switched to the ON-state by the second sheet S (t115). By these actions, the developing rollers 61Y, 61M, 61C, and 61K are sequentially moved again to their contact positions from their separated positions.

The controller 2 turns off the YMC clutch 140A (t117) when the second predetermined time period T12 has elapsed since a timing at which the YMC clutch 140A is turned on.

In addition, the controller 2 turns off the K clutch 140K when the second predetermined time period T22 has elapsed since a timing at which the K clutch 140K is turned on (t116).

The controller 2 turns on the YMC clutch 140A (t119) when the third predetermined time period T13 has elapsed since a timing at which the post-registration sensor 28C is switched to the OFF-state by the second sheet S having passed through the post-registration sensor 28C (t118). Further, the controller 2 turns on the K clutch 140K (t120) when the third predetermined time period T23 has elapsed since the timing at which the post-registration sensor 28C is switched to the OFF-state by the second sheet S having passed through the post-registration sensor 28C (t118). By these actions, all the developing rollers 61Y, 61M, 61C, and 61K are subsequently moved from their contact positions to their separated positions.

The controller 2 turns off the YMC clutch 140A when the separation sensor 4C is switched to the ON-state (t121), and turns off the K clutch 140K when the separation sensor 4K is switched to the ON-state (t122).

(2) Case of Short Sheet Interval

Hereinafter, like operations are designated by the same marks or symbols as those shown illustrated in FIG. 9 to avoid duplicating description. The differences of the time chart illustrated in FIG. 10 from that of FIG. 9 will be described in detail.

As illustrated in FIG. 10, in a case where the post-registration sensor 28C is switched to the ON-state by the second sheet S at the time that the predetermined time period T13 elapses (t108) from a timing at which the post-registration sensor 28C is switched to the OFF-state by the first sheet S having passed through the post-registration sensor 28C (t107), the sheet interval Si is short. Accordingly, in this case, the controller 2 does not rotate any of the cams 150Y, 150M, 150C, and 150K by leaving the clutches 140A and 140K turned off, thereby maintaining all the developing rollers 61Y, 61M, 61C, and 61K at their contact positions.

The controller 2 turns on the YMC clutch 140A (t212) when the third predetermined time period T13 has elapsed since a timing at which the post-registration sensor 28C is switched to the OFF-state by the second sheet S having passed through the post-registration sensor 28C (t211). Further, the controller 2 turns on the K clutch 140K (t213) when the third predetermined time period T23 has elapsed since the timing at which the post-registration sensor 28C is switched to the OFF-state by the second sheet S having passed through the post-registration sensor 28C (t211). By these actions, all the developing rollers 61Y, 61M, 61C, and 61K are sequentially moved from their contact positions to their separated positions.

The controller 2 turns off the YMC clutch 140A (t214) when the separation sensor 4C is switched to the ON-state, and turns off the K clutch 140K (t215) when the separation sensor 4K is switched to the ON-state.

(3) Case of Middling Sheet Interval

As illustrated in FIG. 11, in a case where, at the time that the third predetermined time period T13 elapses (t108) from a timing at which the post-registration sensor 28C is switched to the OFF-state by the first sheet S having passed through the post-registration sensor 28C (t107), the post-registration sensor 28C is not switched to the ON-state because of non-detection of the second sheet S but the sheet supply sensor 28A is switched to the ON-state by the second sheet S, the sheet interval Si is middling and accordingly, the controller 2 do not rotate the cams 150Y, 150M, and 150C by leaving the YMC clutch 140A turned off, thereby maintaining the developing rollers 61Y, 61M, and 61C at their contact positions.

On the other hand, the controller 2 turns on the K clutch 140K (t311) when the third predetermined time period T23 has elapsed since the timing at which the post-registration sensor 28C is switched to the OFF-state by the first sheet S having passed through the post-registration sensor 28C (t107). By this action, the K developing roller 61K is moved from the contact position to the separated position.

In the case illustrated in FIG. 9 the controller 2 turns off the K clutch 140K when the separation sensor 4K is switched to the ON-state (t122), and in the case illustrated in FIG. 10 the controller 2 turns off the K clutch 140K when the separation sensor 4K is switched to the ON-state (t215). In contrast, in the case illustrated in FIG. 11, the controller 2 leaves the K clutch 140K in the ON-state even when the separation sensor 4K is switched to the ON-state (t312). This is because, at the time of the switch of the separation sensor 4K to the ON-state (t312), the first predetermined time period T21 has elapsed since the timing at which the post-registration sensor 28C is switched to the ON-state by the second sheet S. That is, in the case illustrated in FIG. 11, the sheet interval is middling, i.e., the sheet interval is such an interval that the developing rollers 61Y, 61M, and 61C cannot make one round trip (move from their contact positions to their separated positions and return again to their contact positions) but only the developing roller 61K can make one round trip (move from its contact position to its separated position and return again to its contact position). Hence, the controller 2 maintains the developing rollers 61Y, 61M, and 61C at their contact positions but temporarily move the developing roller 61K to its separated position from its contact position and return the developing roller 61K again to its contact position.

Note that, as an alternative, the K clutch 140K may be turned off for a moment at the timing t312, and immediately thereafter, the K clutch 140K may be turned on again. By this action, the K developing roller 61K can move back to the contact position from the separated position. Then, the controller 2 turns off the K clutch 140K when the second predetermined time period T22 has elapsed.

The controller 2 turns on the YMC clutch 140A (t314) when the third predetermined time period T13 has elapsed since a timing at which the post-registration sensor 28C is switched to the OFF-state by the second sheet S having passed through the post-registration sensor 28C (t313). The controller 2 turns on the K clutch 140K (t315) when the third predetermined time period T23 has elapsed since the timing at which the post-registration sensor 28C is switched to the OFF-state by the second sheet S having passed through the post-registration sensor 28C (t313). By these actions, the developing rollers 61Y, 61M, 61C, and 61K are sequentially moved from their contact positions to their separated positions.

The controller 2 turns off the YMC clutch 140A (t316) when the separation sensor 4C is switched to the ON-state, and turns off the K clutch 140K (t317) when the separation sensor 4K is switched to the ON-state.

According to the image forming apparatus 1 of the above-described embodiment, in a case where the sheet interval is middling, the K developing roller 61K can be temporarily separated from the corresponding photosensitive drum 50K after the first sheet S has passed through the K photosensitive drum 50K and before the second sheet S reaches the K photosensitive drum 50K. Therefore, a time period of the contact between the K developing roller 61K and the K photosensitive drum 50K which are used not only in color printing but also in monochromatic printing, that is, subject to high usage frequency can be reduced. Hence, prolonged service life of black toner and the K developing roller 61K can be obtained.

Further, the first moving mechanism 5A and the second moving mechanism 5K are configured such that the second separation time period TS2 of the K cam 150K is shorter than both the first separation time period TS1 of the Y cam 150Y and the third separation time TS3 of the cams 150M and 150C. Hence, the period of time for the K developing roller 61K to move to the separated position from the contact position and then to move again to the contact position can be shorter than those for the developing rollers 61Y, 61M, and 61C.

Further, in a case of the long sheet interval, the developing rollers 61 (61Y, 61M, 61C, 61K) can be temporarily separated from the corresponding photosensitive drums 50 (50Y, 50M, 50C, 50K) after the first sheet S has passed through the K photosensitive drum 50K and before the second sheet S reaches the Y photosensitive drum 50Y. Hence, the time period of the contact between each of the developing rollers 61 and the corresponding photosensitive drum 50 can be reduced. Accordingly, service life of toners of respective colors and the developing rollers 61 can be prolonged. Further, even in a case where the sheet interval is middling and thus temporary separation of the developing rollers 61Y, 61M, and 61C from the corresponding photosensitive drums 50 cannot be performed, the K developing roller 61K can be temporarily separated from the K photosensitive drum 50K. Hence, the time period of the contact between the K developing roller 61K and the K photosensitive drum 50K which have high usage frequency can be further reduced.

Further, the controller 2 controls the second moving mechanism 5K such that the K developing roller 61K is moved to the contact position after the developing rollers 61Y, 61M, and 61C are moved to the contact positions. Hence the developing rollers 61Y, 61M, 61C, 61K are sequentially moved to the contact positions in this order in conformance with the conveyance of the sheet S. Therefore, a time period for waiting arrival of the sheet S at the K developing roller 61K in a state where the K developing roller 61K is in contact with the K photosensitive drum 50K can be reduced in comparison with a configuration in which all the developing rollers 61Y, 61M, 61C, and 61K are moved to the contact positions at approximately the same time. Hence, the time period of the contact between the K developing roller 61K and the K photosensitive drum 50K which have high usage frequency can be further reduced.

Further, the controller 2 controls the first moving mechanism 5A such that the developing rollers 61Y, 61M, and 61C are moved to the separated positions before the K developing roller 61K is moved to the separated position. Hence, the developing rollers 61Y, 61M, 61C, and 61K are sequentially moved to the separated positions in this order in conformance with the conveyance of the sheet S. Here, development of an image by the developing rollers 61Y, 61M, 61C is finished earlier than that by the K developing roller 61K. In this connection, the developing rollers 61Y, 61M, and 61C can be promptly separated from the corresponding photosensitive drums 50Y, 50M, 50C after the completion of their development. Accordingly, the time period of the contact between the developing rollers 61Y, 61M, and 61C and the corresponding photosensitive drums 50Y, 50M, 50C can be reduced.

Further, the first moving mechanism 5A includes the cams 150Y, 150M, and 150C, and the second moving mechanism 5K includes the cam 150K. Hence, by changing profiles of the cams 150Y, 150M, 150C, and 150K, it is relatively easy to set the second separation time period TS2 to a shorter time period than both the first separation time period TS1 and the third separation time TS3.

While the description has been made in detail with reference to the specific embodiment, it would be apparent to those skilled in the art that various changes and variations may be made thereto. Hereinafter, various modifications of the embodiment will be described.

For example, in the above-described embodiment, three kinds of lengths (long, short, middling) of the sheet interval is determined on the basis of the results of detections (ON-state or Off-state) by the post-registration sensor 28C and the sheet supply sensor 28A at the time that the predetermined period of time has elapsed since the timing at which the post-registration sensor 28C is switched to the OFF-state by the first sheet S having passed through the post-registration sensor 28C. Alternatively, as a modification, the sheet interval may be calculated on the basis of signals transmitted from the sensors 28A, 28B, and 28C, and how long the sheet interval is may be determined by comparing the calculated interval with the threshold value (s), e.g., the first interval and the second interval.

Further, the above-described structure for contact and separation of the developing rollers 61 relative to the corresponding photosensitive drums 50 is an example. For example, an end cam and other cams may be available instead of the cam having the cam crest on the peripheral surface in the above-described embodiment.

Further, although the cam 150 directly presses the developing cartridge 60 in the above-described embodiment, an additional pressing member such as a cam follower may be added so that the cam 150 presses the cam follower and the cam follower press the developing roller 61. Further, in the above-described embodiment, the developing rollers 61 is supported to be movable in the frontward/rearward direction. However, the developing rollers 61 may be supported to be movable in the upward/downward direction.

Further, according to the above-described embodiment, the profiles of the cams 150 are changed in the first moving mechanism 5A and the second moving mechanism 5K in order to set the second separation time period TS2 (second time period) shorter than the first separation time period TS1 (first time period). However, alternatively, the same members having the same profile may be employed as a first cam and a second cam and the rotation speed of the second cam may be higher than that of the first cam in order to set the second time period shorter than the first time period. In this case, the second time period can be easily set shorter than the first time period by setting the rotation speed of the first cam and the second cam different from each other since the first moving mechanism includes the first cam and the second moving mechanism includes the second cam.

Further, although the image forming apparatus 1 according to the above-described embodiment employs four-color toners for color printing, an image forming apparatus employing two or three-color toners or not less than five-color toners is also available. That is, although the image forming apparatus 1 according to the embodiment includes three first photosensitive drums 50Y, 50M, and 50C, three first developing rollers 61Y, 61M, and 61C, a single second photosensitive drum 50K, and a single second developing roller 61K, the number of the first photosensitive drums 50 may be only one, two, or not less than four and the number of the first developing rollers 61 may be only one, two, or not less than four. Further, the number of the second photosensitive drums 50 may be two or more and the number of the second developing roller 61 may be two or more. Further, not only the printer but also a copying machine, a multi-function device, and the like are also available as the image forming apparatus.

Further, in the image forming apparatus 1 according to the above-described embodiment, the K photosensitive drum 50K (second photosensitive drum) is positioned downstream of the photosensitive drums 50Y, 50M, and 50C (first photosensitive drum) in the conveying direction of the sheet S. However, the second photosensitive drum may be positioned upstream of the first photosensitive drum in the sheet conveying direction.

The components employed in the above-described embodiment and modifications can be implemented combined as appropriate.

What is claimed is:

1. An image forming apparatus comprising:

a first photosensitive drum;

a second photosensitive drum;

a first developing roller movable between:

a first contact position in which the first developing roller is in contact with the first photosensitive drum; and a first separated position in which the first developing roller is separated from the first photosensitive drum;

a second developing roller movable between:

a second contact position in which the second developing roller is in contact with the second photosensitive drum; and a second separated position in which the second developing roller is separated from the second photosensitive drum;

a first moving mechanism configured to move the first developing roller between the first contact position and the first separated position;

a second moving mechanism configured to move the second developing roller between the second contact position and the second separated position; and a controller configured to execute:

color printing in which an image is formed on a sheet using the first developing roller and the second developing roller; and monochromatic printing in which an image is formed on a sheet using only the second developing roller, the controller being configured to perform, in a case where the color printing is to be performed on both a first sheet and a second sheet following the first sheet, when a sheet interval that is an interval between the first sheet and the second sheet in a conveying direction of the sheet is shorter than a first interval and is longer than or equal to a second interval that is shorter than the first interval:

controlling the first moving mechanism to maintain the first developing roller at the first contact position even after the first developing roller completes development on the first photosensitive drum of an image to be transferred to the first sheet;

controlling the first developing roller maintained at the first contract position to start development on the first photosensitive drum of an image to be transferred to the second sheet;

controlling the second moving mechanism to:

move the second developing roller from the second contact position to the second separated position after the second developing roller completes development on the second photosensitive drum of an image to be transferred to the first sheet; and move the second developing roller again to the second contact position in conformance with a conveyance of the second sheet; and after the second developing roller is moved again to the second contact position, controlling the second developing roller to start development on the second photosensitive drum of an image to be transferred to the second sheet.

2. The image forming apparatus according to claim 1, wherein the first moving mechanism and the second moving mechanism are configured such that a first time period is longer than a second time period, the first time period being a period of time from a timing at which the first developing roller at the first contact position starts separating from the first photosensitive drum to a timing at which the first developing roller again contacts the first photosensitive drum, the second time period being a period of time from a timing at which the second developing roller at the second contact position starts separating from the second photosensitive drum to a timing at which the second developing roller again contacts the second photosensitive drum.

3. The image forming apparatus according to claim 2, wherein the controller is configured to further perform, in the case where the color printing is to be performed on both the first sheet and the second sheet following the first sheet:

when the sheet interval is longer than or equal to the first interval, controlling the first moving mechanism to:

move the first developing roller from the first contact position to the first separated position after the first developing roller completes development on the first photosensitive drum of an image to be transferred to the first sheet; and move the first developing roller again to the first contact position in conformance with a conveyance of the second sheet;

after the first developing roller is moved again to the first contact position, controlling the first developing roller to start development on the first photosensitive drum of an image to be transferred to the second sheet;

controlling the second moving mechanism to:

move the second developing roller from the second contact position to the second separated position after the second developing roller completes development on the second photosensitive drum of an image to be transferred to the first sheet; and move the second developing roller again to the contact position in conformance with a conveyance of the second sheet; and after the second developing roller is moved again to the second contact position, controlling the second developing roller to start development on the second photosensitive drum of an image to be transferred to the second sheet; and when the sheet interval is shorter than the second interval, controlling the first moving mechanism to maintain the first developing roller at the first contact position even after the first developing roller completes development on the first photosensitive drum of an image to be transferred to the first sheet;

controlling the first developing roller maintained at the first contract position to start development on the first photosensitive drum of an image to be transferred to the second sheet;

controlling the second moving mechanism to maintain the second developing roller at the second contact position even after the second developing roller completes development on the second photosensitive drum of an image to be transferred to the first sheet; and controlling the second developing roller maintained at the second contract position to start development on the second photosensitive drum of an image to be transferred to the second sheet.

4. The image forming apparatus according to claim 1, wherein the second photosensitive drum is positioned downstream of the first photosensitive drum in the conveying direction, and wherein the controller is configured to further perform controlling the second moving mechanism such that the second developing roller reaches the second contact position after the first developing roller reaches the first contact position.

5. The image forming apparatus according to claim 4, wherein the controller is configured to further perform controlling the first moving mechanism such that the first developing roller reaches the first separated position before the second developing roller reaches the second separated position.

6. The image forming apparatus according to claim 2, wherein the first moving mechanism includes a first cam configured to rotate, rotation of the first cam moving the first developing roller between the first contact position and the first separated position, and wherein the second moving mechanism includes a second cam configured to rotate, rotation of the second cam moving the second developing roller between the second contact position and the second separated position.

7. An image forming apparatus comprising:

a plurality of first photosensitive drums;

a second photosensitive drum;

a plurality of first developing rollers provided in one-to-one correspondence with the plurality of first photosensitive drums, each of the plurality of first developing rollers being movable between:

a first contact position in which the first developing roller is in contact with the corresponding first photosensitive drum; and a first separated position in which the first developing roller is separated from the corresponding first photosensitive drum;

a second developing roller movable between:

a second contact position in which the second developing roller is in contact with the second photosensitive drum; and a second separated position in which the second developing roller is separated from the second photosensitive drum;

a first moving mechanism configured to move each of the plurality of first developing rollers between the first contact position and the first separated position;

a second moving mechanism configured to move the second developing roller between the second contact position and the second separated position; and a controller configured to execute:

color printing in which an image is formed on a sheet using the plurality of first developing rollers and the second developing roller; and monochromatic printing in which an image is formed on a sheet using only the second developing roller, the controller being configured to perform, in a case where the color printing is to be performed on both a first sheet and a second sheet following the first sheet, when a sheet interval that is an interval between the first sheet and the second sheet in a conveying direction of the sheet is shorter than a first interval and is longer than or equal to a second interval that is shorter than the first interval:

controlling the first moving mechanism to maintain each of the plurality of first developing rollers at the first contact position even after the first developing roller completes development on the corresponding first photosensitive drum of an image to be transferred to the first sheet;

controlling each of the plurality of first developing rollers maintained at the first contract positions to start development on the corresponding first photosensitive drum of an image to be transferred to the second sheet;

controlling the second moving mechanism to:

move the second developing roller from the second contact position to the second separated position after the second developing roller completes development on the second photosensitive drum of an image to be transferred to the first sheet; and move the second developing roller again to the second contact position in conformance with a conveyance of the second sheet; and after the second developing roller is moved again to the second contact position, controlling the second developing roller to start development on the second photosensitive drum of an image to be transferred to the second sheet.

8. An image forming apparatus comprising:

three first photosensitive drums;

a single second photosensitive drum;

three first developing rollers provided in one-to-one correspondence with the three first photosensitive drums, each of the three first developing rollers being movable between:

a first contact position in which the first developing roller is in contact with the corresponding first photosensitive drum; and a first separated position in which the first developing roller is separated from the corresponding first photosensitive drum;

a single second developing roller provided for the single second photosensitive drum, the single second developing roller being movable between:

a second contact position in which the single second developing roller is in contact with the single second photosensitive drum; and a second separated position in which the single second developing roller is separated from the single second photosensitive drum;

a first moving mechanism configured to move each of the three first developing rollers between the first contact position and the first separated position;

a second moving mechanism configured to move the single second developing roller between the second contact position and the second separated position; and a controller configured to execute:

color printing in which an image is formed on a sheet using the three first developing roller and the single second developing roller; and monochromatic printing in which an image is formed on a sheet using only the single second developing roller, the controller being configured to perform, in a case where the color printing is to be performed on both a first sheet and a second sheet following the first sheet, when a sheet interval that is an interval between the first sheet and the second sheet in a conveying direction of the sheet is shorter than a first interval and is longer than or equal to a second interval that is shorter than the first interval:

controlling the first moving mechanism to maintain each of the three first developing rollers at the first contact position even after the first developing roller completes development on the corresponding first photosensitive drum of an image to be transferred to the first sheet;

controlling each of the three first developing rollers maintained at the first contract positions to start development on the corresponding first photosensitive drum of an image to be transferred to the second sheet;

controlling the second moving mechanism to:

move the single second developing roller from the second contact position to the second separated position after the single second developing roller completes development on the single second photosensitive drum of an image to be transferred to the first sheet; and move the single second developing roller again to the second contact position in conformance with a conveyance of the second sheet; and after the single second developing roller is moved again to the second contact position, controlling the single second developing roller to start development on the single second photosensitive drum of an image to be transferred to the second sheet.

* * * * *